US011493307B2

(12) United States Patent
Ahn et al.

(10) Patent No.: US 11,493,307 B2
(45) Date of Patent: Nov. 8, 2022

(54) APPARATUS AND METHOD FOR INVISIBILITY CLOAKING APPARATUS

(71) Applicant: University of Seoul Industry Cooperation Foundation, Seoul (KR)

(72) Inventors: Do Yeol Ahn, Seoul (KR); Yong Yoon Lee, Seoul (KR)

(73) Assignee: Univ. of Seoul Industry Cooperation Foundation, Seoul (KR)

( * ) Notice: Subject to any disclaimer, the term of this patent is extended or adjusted under 35 U.S.C. 154(b) by 335 days.

(21) Appl. No.: 15/931,007

(22) Filed: May 13, 2020

(65) Prior Publication Data

US 2020/0271425 A1 Aug. 27, 2020

Related U.S. Application Data

(60) Division of application No. 15/094,350, filed on Apr. 8, 2016, now abandoned, which is a continuation of application No. PCT/KR2014/009396, filed on Oct. 7, 2014.

(30) Foreign Application Priority Data

Oct. 8, 2013 (KR) ..... 10-2013-0119547

(51) Int. Cl.

| | |
|---|---|
| ***H01Q 1/42*** | (2006.01) |
| ***H01Q 15/00*** | (2006.01) |
| ***F41H 3/00*** | (2006.01) |

(52) U.S. Cl.

CPC ..... *F41H 3/00* (2013.01); *H01Q 1/42* (2013.01); *H01Q 15/00* (2013.01); *H01Q 15/0086* (2013.01)

(58) Field of Classification Search

CPC ..... H01Q 1/42; H01Q 15/0086; H01Q 15/00; F41H 3/00

See application file for complete search history.

(56) References Cited

U.S. PATENT DOCUMENTS

| | | | | |
|---|---|---|---|---|
| 10,460,713 | B2 * | 10/2019 | Ahn | G06F 17/16 |
| 10,468,011 | B2 * | 11/2019 | Ahn | G10K 11/172 |
| 11,355,663 | B2 * | 6/2022 | Ko | H01L 33/40 |
| 2016/0298935 | A1 * | 10/2016 | Ahn | H01Q 1/42 |

(Continued)

OTHER PUBLICATIONS

Lai, Y. et al "A complementary media invisibility cloak that can cloak objects at a distance outside the cloaking shell" Dept of Physics, The Hong Kong Univ of Sci. and Tech., 12 pages. Phys. Rev. Lett. 102,93901; (Year: 2009).*

*Primary Examiner* — Hai V Tran

(74) *Attorney, Agent, or Firm* — United One Law Group LLC; Kongsik Kim; Jhongwoo Peck

(57) ABSTRACT

A cloaking apparatus and method are disclosed herein. The cloaking apparatus for cloaking a target object using meta-material includes a compensation unit, and a cloaking cell. The compensation unit is disposed in a second space surrounding part of a first space including the target object, and is composed of a first meta-material having a predetermined negative refractive index. The cloaking shell is configured to surround part of the compensation unit, and is composed of a second meta-material. The negative refractive index may be a negative refractive index that is adapted to cloak the target object by compensating for the positive refractive index of the first space.

10 Claims, 21 Drawing Sheets

(56) References Cited

U.S. PATENT DOCUMENTS

| | | | | |
|---|---|---|---|---|
| 2017/0098440 | A1* | 4/2017 | Ahn | G06F 17/11 |
| 2020/0184941 | A1* | 6/2020 | Ahn | G10K 11/162 |
| 2020/0271425 | A1* | 8/2020 | Ahn | F41H 3/00 |

* cited by examiner

APPARATUS AND METHOD FOR INVISIBILITY CLOAKING APPARATUS

CROSS-REFERENCE TO RELATED APPLICATION

This application is a division of application Ser. No. 15/094,350 filed on Apr. 8, 2016, which is a continuation of PCT/KR2014/009396 filed on Oct. 7, 2014, which claims priority to Korean Application No. 10-2013-0119547 filed on Oct. 8, 2013. The entire contents of these applications are incorporated herein by reference in their entirety.

TECHNICAL FIELD

The present invention relates generally to a cloaking apparatus and method, and more particularly to a cloaking apparatus and method that are capable of implementing an invisibility cloak using a complementary medium without completely surrounding a target object.

BACKGROUND ART

Recent research into meta-material has enabled microscopic control and macroscopic control for an electromagnetic field (see Phys. Rev. Lett. 85, 3966 (2000); Science 312, 1777 (2006); Science 312, 1780 (2006)). Meta-material is material in which electromagnetic characteristics that cannot be realized in a general natural state are realized using an artificial method. Meta-material is characterized in that it has a negative refractive index and, thus, light is bent in the direction, opposite to a direction in which the light is bent in normal material, in the meta-material.

A scheme for freely adjusting the direction of an electromagnetic field regardless of the source of the electromagnetic field and also providing guidance while avoiding an object as if there was no object by using such meta-material was proposed (see Science 312, 1777 (2006); Science 312, 1780 (2006)). This can be potentially applied to radiation shielding from a strong electromagnetic pulse (EMP) or electromagnetic energy having directionality.

Electromagnetic field control using meta-material is attracting considerable attention in the fields of novel applications, such as an invisibility cloak, a concentrator, and a refractor.

Among these applications, an invisibility cloak is intended to hide an object inside a given geometrical shape, and is the most attractive application. An invisibility cloak is based on the coordinate transformation and conformal mapping of Maxwell's equations, and such invisibility cloaks were independently proposed by Pentry (see Science 312, 1780 (2006)) and Leonhardt (see Science 312, 1777 (2006)).

The full wave electromagnetic simulation of a cylindrical cloak using ideal or non-ideal electromagnetic parameters has been researched, and the experimental implementation of a cylindrical cloak having simple parameters, which operates at a microwave frequency, was announced.

In the analysis and design of a cloaking apparatus, it is most important to calculate permittivity and permeability tensors for meta-material that constitutes a cloaking shell.

It is assumed that a cloaking apparatus distorts field lines so that the field lines move while avoiding any area having uniform field lines in the corresponding area. This distortion may be considered to be coordinate transformation between an original Cartesian mesh and a distortion mesh.

The theory and experimental implementation of the conventional cloaking apparatus is significantly influenced by the propagation direction of an electromagnetic wave, polarized light, and a wavelength band. Although technology for improving the efficiency of a cloaking apparatus using complementary media was proposed in the paper "Complementary media invisibility cloak that cloaks objects at a distance outside the cloaking shell," Y. Lai, H. Chen, Z. Q. Zhang, and C. Chan, Phys. Rev. Lett. 102, 93901 (2009) (published on May 2, 2009), this preceding technology self-proclaims that it is valid at finite frequencies only.

Attempts to overcome this limitation and extend the preceding technology to a theory that is applicable to more general cases were introduced in "Calculation of Permittivity Tensors for Invisibility Devices by Effective Medium Approach in General Relativity", Doyeol Ahn, Journal of Modern Optics, Volume 58, Issue 8, 2011 (published on Apr. 4, 2011) and Korean Patent Application Publication No. 10-2013-0047860 (published on May 9, 2013).

In the approaches of the preceding technologies, permittivity and permeability tensors may be scaled using factors obtained via coordinate transformation or optical conformal mapping technology while maintaining the forms of Maxwell's equations that do not change in any coordinate system.

Furthermore, a method for calculating permittivity and permeability tensors for a cloaking apparatus using electrodynamics in the frame of the Theory of Relativity was researched.

The principle idea of this preceding technology is based on the fact that in curved space-time, the propagation of an electromagnetic wave appears as wave travelling in an inhomogeneous effective bi-anisotropic medium. The constitutive parameters thereof are determined by a space-time metric.

This can express the inverse problem of conversion into any curve space-time in a medium inside flat space-time, and can find specific conditions for invisibility cloaking.

The above-described conventional technologies are configured to completely surround a target object with meta-material in order to cloak the target object, and have a problem in that a target object must be located within a space that is formed by a cloaking apparatus.

The present invention proposes a scheme that is capable of cloaking a target object even when a cloaking apparatus does not completely surround the target object.

SUMMARY OF THE DISCLOSURE

Accordingly, the present invention has been made to solve the above problems occurring in the prior art, and an object of the present invention is to provide a cloaking apparatus and method that are capable of implementing an invisibility cloak using a complementary medium without completely surrounding a target object.

More specifically, an object of the present invention is to provide a cloaking apparatus and method that are capable of improving the cloaking of a target object in such a manner that meta-material, having a negative refractive index, for compensating for the positive refractive index of a space where the target object is disposed is disposed to surround part of a space including the target object.

Another object of the present invention is to provide a cloaking apparatus and method that are capable of performing cloaking with respect to arbitrary polarized light and an electromagnetic wave having an arbitrary propagation direction.

According to an aspect of the present invention, there is provided a cloaking apparatus for cloaking a target object using meta-material, including: a compensation unit disposed in a second space surrounding part of a first space including the target object, and composed of a first meta-material having a predetermined negative refractive index; and a cloaking shell configured to surround part of the compensation unit, and composed of a second meta-material.

The negative refractive index may be a negative refractive index that is adapted to cloak the target object by compensating for the positive refractive index of the first space.

The compensation unit may include at least two sub compensation units, composed of meta-material having a negative refractive index, for compensating for each of the at least two positive refractive indices when the first space has at least two positive refractive indices.

The at least two sub compensation units may be disposed to be symmetrical to spaces for the at least two positive refractive indices by taking into account the negative refractive indices of the sub compensation units.

The second meta-material may be designed to cloak the target object by distorting space-time surrounding the first space and the second space for electromagnetic waves.

The second meta-material may be designed by applying an analysis technique that makes changes in propagation paths of the electromagnetic waves attributable to distortion of space-time surrounding part of the first space and the second space correspond to refractive indices for the electromagnetic waves.

According to another aspect of the present invention, there is provided a cloaking apparatus for cloaking a target object using meta-material, including: a compensation unit disposed in a second space spaced apart from a first space, including the target object, by a predetermined interval, and composed of a first meta-material having a predetermined negative refractive index; and a cloaking shell configured to surround the compensation unit, disposed to be spaced apart from the first space, and composed of a second meta-material.

The predetermined interval and a space in which the cloaking shell is disposed may be determined by taking into account a cloaking space for the target object.

The compensation unit may be disposed in the second space having a size corresponding to the size of the first space.

The negative refractive index may be a negative refractive index that is adapted to cloak the target object by compensating for the positive refractive index of the first space.

According to still another aspect of the present invention, there is provided a cloaking method for cloaking a target object in a predetermined first space using meta-material, including: disposing a compensation unit, composed of a first meta-material having a predetermined negative refractive index, in a second space surrounding part of a first space; and disposing a cloaking shell, composed of a second meta-material, to surround part of the compensation unit.

According to still another aspect of the present invention, there is provided a cloaking method for cloaking a target object using meta-material, including: disposing a compensation unit, composed of a first meta-material having a predetermined negative refractive index, in a second space spaced apart from a first space, including the target object, by a predetermined interval; and disposing a cloaking shell, configured to surround the compensation unit and composed of a second meta-material, to be spaced apart from the first space.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE DISCLOSURE

Figure 1:
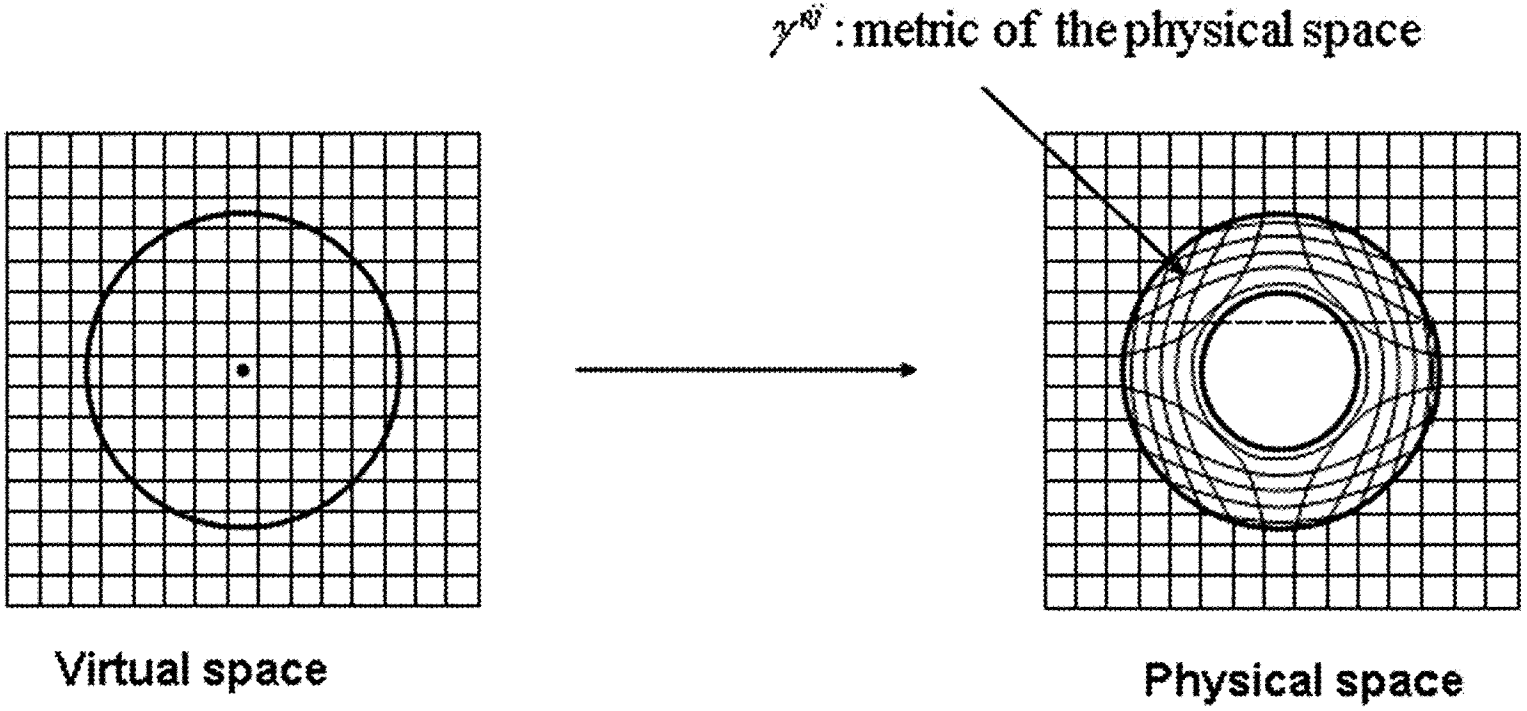
FIG. 1 shows an example of an invisibility cloak based on a space-time meta-material analysis method based on the General Theory of Relativity.

Embodiments of the present invention will be described in detail with reference to the accompanying drawings. In the following description of the present invention, detailed descriptions of related well-known components or functions that may unnecessarily make the gist of the present invention obscure will be omitted.

The prevent invention is not limited to the embodiments. Throughout the accompanying drawings, the same reference symbols are assigned to the same components.

A cloaking apparatus and method according to some embodiments of the present invention are described with reference to FIGS. 1 to 9D in detail below.

The term "meta-material" used herein is described as follows. The meta-material is used to refer to material that can artificially control or design permittivity and permeability tensors, or is used to refer to material that is obtained as a result of the control or design.

A cloaking apparatus is based on theoretical grounds in which when Maxwell's equations are established in space-time having finite curvature, the curvature of the space-time acts like permittivity and permeability with respect to electric and magnetic fields.

More specifically, in the General Theory of Relativity, the covariant Maxwell's equations may be expressed as Equation 1 below:

$$F^{\mu\nu}_{;\mu} = \frac{\varepsilon_0}{\sqrt{-g}} \frac{\partial}{\partial x^\mu}\left(\sqrt{-g}\,F^{\mu\nu}\right) = -J^\nu \tag{1}$$

$$F_{\mu\nu;\lambda} + F_{\lambda\mu;\nu} + F_{\nu\lambda;\mu} = 0$$

where the subscript ";" is a covariant derivative, $\varepsilon_0$ is permittivity in free space, and μ,v and λ are respective components in 4D coordinate space in an arbitrary 4D coordinate system.

Furthermore, g is the determinant of metric tensor $g_{\mu\nu}$, J is current density, and $F_{\mu\nu}$ is an electromagnetic field tensor.

The process of deriving Equation 1 is disclosed in Korean Patent Application Publication No. 10-2013-0047860 (published on May 9, 2013) and "Calculation of permittivity tensors for invisibility devices by effective medium approach in general relativity", Doyeol Ahn, Journal of Modern Optics, Volume 58, Issue 8, 2011 (published on Apr. 1, 2011). Furthermore, the processes of deriving the following plurality of equations are disclosed in the above-described preceding technology documents. Accordingly, in the present specification, brief descriptions will be given with a focus on principal items, adopted in the present invention, within the range in which the gist of the present invention is not made obscure.

In this case, the electromagnetic field tensor may be expressed as Equation 2 below. The electromagnetic field tensor is described in the form of a matrix of a zero dimension (time) and the three dimensions of space in the General Theory of Relativity.

$$F_{\mu\nu} = \begin{pmatrix} 0 & -E_x & -E_y & -E_z \\ E_x & 0 & B_z & -B_y \\ E_y & -B_z & 0 & B_x \\ E_z & B_y & -B_x & 0 \end{pmatrix} \tag{2}$$

where E is an electric field, x,y and z are directions, and B is electric flux.

Furthermore, contra-variant tensor $H^{\mu\nu}$ may be expressed Equation 3 below, and Equation 3 may be defined by Equation 4 below:

$$H^{\mu\nu} = \varepsilon_0 \frac{\sqrt{-g}}{2}\left(g^{\mu\lambda}g^{\nu\rho} - g^{\mu\rho}g^{\nu\lambda}\right)F_{\lambda\rho} \tag{3}$$

$$H^{\mu\nu} = \begin{pmatrix} 0 & D_x & D_y & D_z \\ -D_x & 0 & H_z & -H_y \\ -D_y & -H_z & 0 & H_x \\ -D_z & H_y & -H_x & 0 \end{pmatrix} \tag{4}$$

where H is a magnetic field, and D is magnetic flux.

When the above-described equations are rearranged, relations, i.e., Equations 5 and 6, are obtained below:

$$D_i = (-g)^{1/2}\varepsilon_0\left(g^{0j}g^{i0} - g^{00}g^{ij}\right)E_j + (-g)^{1/2}[jkl]g^{0k}g^{jl}\mu_0^{-1}B_j \tag{5}$$

$$H_i = \frac{1}{\sqrt{-g}}[jkl]g_{0k}g_{il}\varepsilon_0 E_j - \frac{1}{\sqrt{-g}}(g_{i0}g_{j0} - g_{00}g_{ij})\mu_0^{-1}B_j \tag{6}$$

where [ijk] is an anti-symmetric permutation symbol and is defined as [xyz]=1, $\mu_0$ is permeability in free space, $g^{ab}$ is the (a, b) component of a contra-variant metric tensor, and $g_{cd}$ is the (c, d) component of a covariant metric tensor.

From the above-described equations, it can be seen that Maxwell's equations in a vacuum having a finite radius of curvature may be interpreted as Maxwell's equations in a medium having finite permittivity and permeability.

FIG. 1 shows an example of an invisibility cloak based on a space-time meta-material analysis method based on the General Theory of Relativity. An empty space at the center of physical space refers to a space that is used to hide a given object.

Furthermore, virtual space refers to space obtained by transforming the empty space of the physical space into a center point. Using this relationship, an intuitive picture of the invisibility cloak may be generated using the physical space and the virtual space in which actual invisibility cloaking is implemented and coordinate transformation between these two spaces. The coordinate transformation between these two spaces may be described as metric tensor $g_{\mu\nu}$ in space-time. When a metric tensor indicative of curvilinear coordinates in physical space is defined as $\gamma'_{ij}$, a transformation equation between the two spaces is given as Equation 7 below, the permittivity tensor $\varepsilon^{ij}$ and permeability tensor $\mu^{ij}$ of the physical space that are implemented using the meta-material may be expressed as Equation 8 below:

$$g^{ij} = \frac{\partial x^i}{\partial x'^k}\frac{\partial x^j}{\partial x'^l}\gamma'^{kl} \tag{7}$$

$$\varepsilon^{ij} = \pm\frac{(\det(-g))^{1/2}}{\sqrt{\det(\gamma)}}\left(g^{0j}g^{i0} - g^{00}g^{ij}\right), \tag{8}$$

$$\left(\mu^{-1}\right)_{ij} = \pm\frac{\sqrt{\det(\gamma)}}{\sqrt{\det(-g)}}(g_{i0}g_{j0} - g_{00}g_{ij})$$

where γ is $\gamma_{ij}$, and $y^{kk}=1/\gamma_{kk}$.

However, the invisibility cloak implemented using the above-described method has a disadvantage in that when an electromagnetic wave is polarized in a specific direction, the efficiency of invisibility is maximized.

Accordingly, the present invention is directed to a device and method that can overcome the above-described disadvantage and can perform cloaking with respect to arbitrary polarization.

When the content of the papers by J. Mod. Opt. 58, 700-710 (2011), Journal of the Korean Physical Society 60, 1349-1360 (2012), JOSA B 30, 140-148 (2013), which is disclosed by the inventor of the present invention, is used, a target object is hidden in the area of $0<u<U_1$ and a primed coordinate system for empty curved space-time is used on the assumption that a cloaking apparatus includes a meta-material shell in the area of $U_1<u<U_2$, a physical medium may be defined as Equation 9 below.

The coordinate system used in this case is a generalized cylindrical coordinate system, such as a bipolar cylindrical coordinate system.

$$u = U_1 + u'\frac{U_2 - U_1}{U_2},\ v = v',\ z = z' \tag{9}$$

where $U_1$ and $U_2$ are the predetermined values of a space composed of meta-material, u' is a distance in virtual space, u is a distance in physical space, v' is a generalized angle or distance in virtual space, v is a generalized angle or distance in physical space, and z and z' are distances (heights) in a z direction in physical and virtual spaces.

Furthermore, in the General Theory of Relativity, constitutive parameters for an elliptic cylindrical cloaking apparatus or invisibility cloak may be obtained from an effective medium approach, as shown in Equation 10 below:

$$\varepsilon_j^i = \mu_j^i = \mathrm{diag}\left(\left(\frac{U_2 - U_1}{U_2}\right), \left(\frac{U_2}{U_2 - U_1}\right), \left(\frac{U_2}{U_2 - U_1}\right)\frac{\sinh^2 u' + \sin^2 v'}{\sinh^2 u + \sin^2 v}\right) \quad (10)$$

where diag( ) is a diagonal matrix, and $\varepsilon^i_j$ and $\mu^i_j$ are permittivity and permeability tensors in an elliptic cylindrical coordinate system.

Figure 2A:
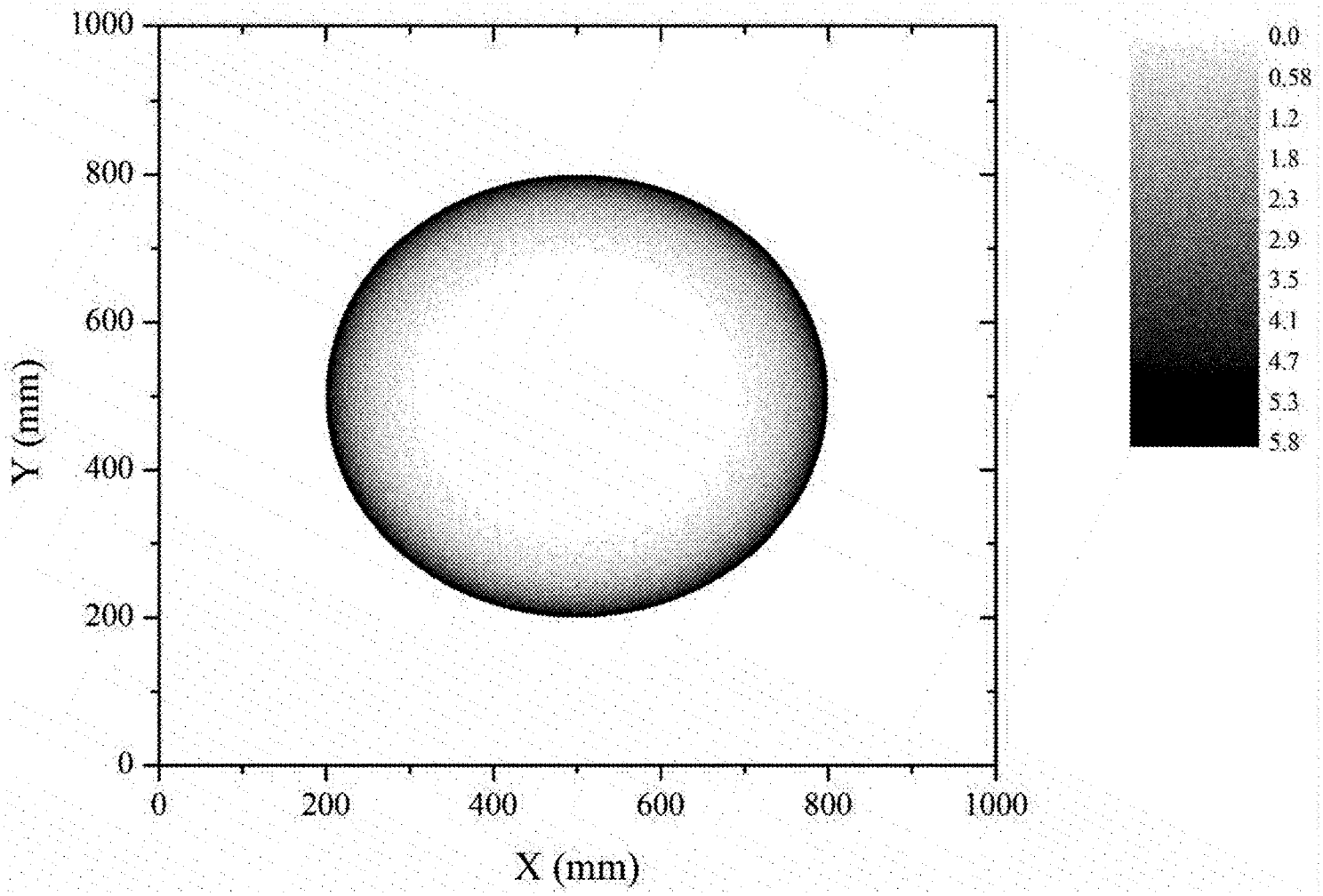
FIGS. 2A through 2C show spatial distributions for the constitutive parameters of an elliptic cylindrical invisibility cloak and a bipolar cylindrical invisibility cloak.
Figure 2B:
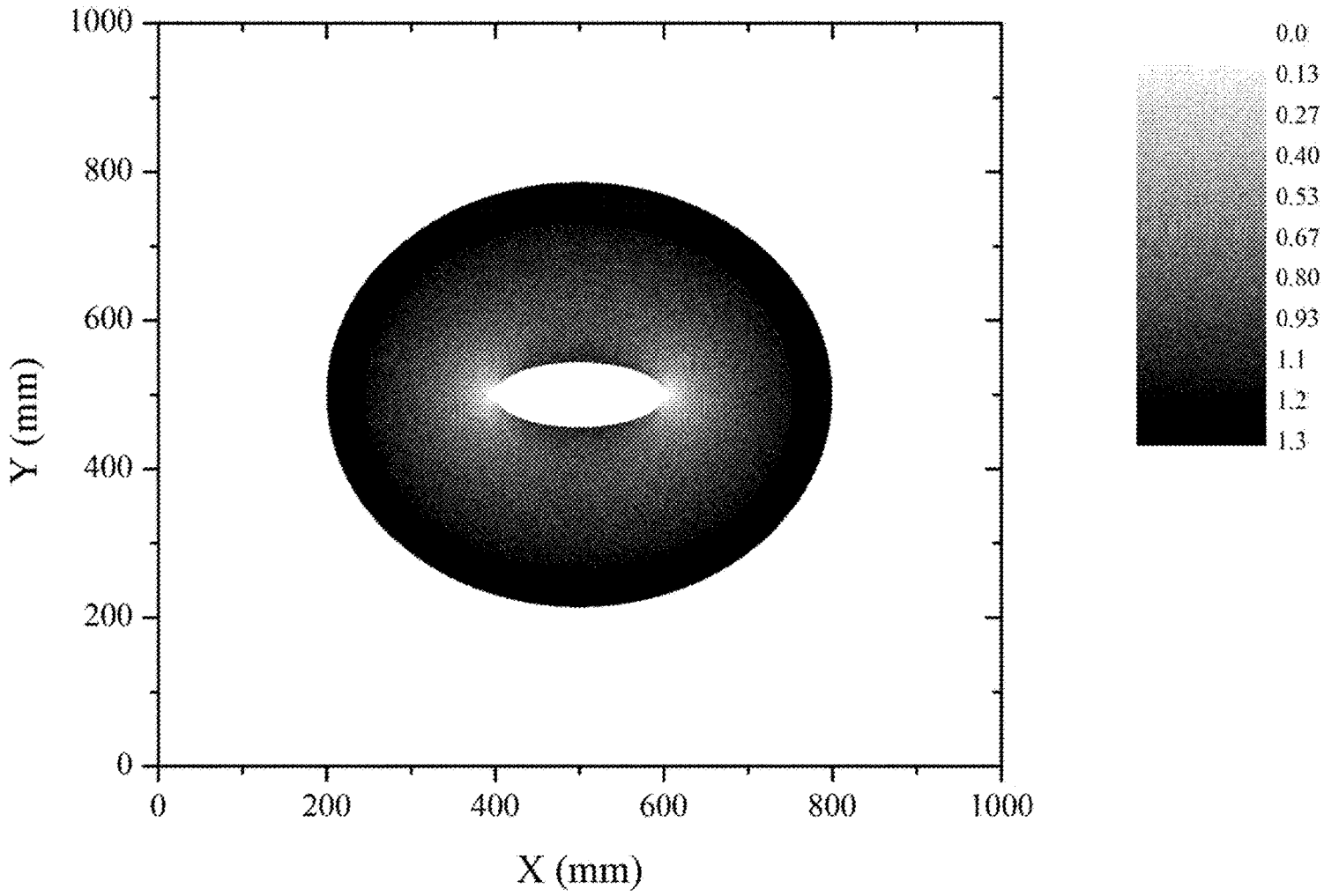

FIGS. 2A and 2B show spatial distributions for the constitutive parameters of an elliptic cylindrical invisibility cloak. FIG. 2A shows a spatial distribution for $\varepsilon_z^z$ of an elliptic cylindrical cloak having the half-length of the principal axis of an ellipse in which $\varepsilon_u^u$ and $\varepsilon_v^v$ have constant values of 0.17 and 5.8, respectively, the semi-focal distance a is 0.001 m (a=0.001 m), and $K_1$ and $K_2$ have 0.1 and 0.3, respectively. FIG. 2B shows a spatial distribution for $\varepsilon_z^z$ of an elliptic cylindrical cloak in which $\varepsilon_u^u$ and $\varepsilon_v^v$ have constant values of 0.75 and 1.3, respectively, the semi-focal distance "a" is 0.09 m, and $K_1$ and $K_2$ have 0.1 and 0.3, respectively.

In this case, the half-length and the semi-focal distance are indicative of the extents of being away from a cylinder, and the relationship between $K_i$ and $U_i$ may be expressed as Equation 11 below:

$$U_i = \mathrm{Re}\left\{\mathrm{arccosh}\left(\frac{K_i}{a}\right)\right\} \quad (11)$$

In the case of a bipolar cylindrical cloak, a space to which a target object to be hidden belongs may be represented using a bipolar cylindrical coordinate system. The bipolar cylindrical coordinate system is described using σ and τ as variables, and σ and τ are described below.

In this case, a target object to be hidden is disposed in the area of $\sigma_1<\sigma<2\pi-\sigma_1$, and a cloaking apparatus is present in the area of $\{\sigma_2<\sigma<\sigma_1\}\cup\{2\pi-\sigma_1<\sigma<2\pi-\sigma_2\}$. In this case, σ is an angle or generalized distance in physical space, and $\sigma_1$ and $\sigma_2$ are predetermined angles or generalized distances in physical space.

As a result, a map may be defined by Equation 12 below:

$$\sigma = \frac{\sigma_2 - \sigma_1}{\sigma_2 - \pi}(\sigma' - \pi) + \sigma_1,\ \sigma' \in [\sigma_2, \pi] \quad (12)$$

$$\sigma = \frac{\sigma_2 - \sigma_1}{\sigma_2 - \pi}(\sigma' - \pi) + 2\pi - \sigma_1,\ \sigma' \in [\pi, 2\pi - \sigma_2]$$

$$\tau = \tau',\ z = z'$$

where σ' is an angle in virtual space, σ is an angle in physical space, and τ and τ' are the ratios between distances d1 and d2 with respect to angles σ and σ' at any one point P in a bipolar cylindrical coordinate system in physical and virtual spaces. This can be easily understood by those skilled in the art from information about a bipolar cylindrical coordinate system (see information, such as https://en.wikipedia.org/wiki/Bipolar coordinates and the like) and the relationship between the virtual and physical spaces of FIG. 1.

Accordingly, constitutive parameters for a bipolar cylindrical cloaking apparatus or an invisibility cloak may be obtained from Equation 13 below:

$$\varepsilon_j^i = \mu_j^i = \mathrm{diag}\left(\frac{\sigma_2 - \sigma_1}{\sigma_2 - \pi}, \frac{\sigma_2 - \pi}{\sigma_2 - \sigma_1}, \frac{\sigma_2 - \pi}{\sigma_2 - \sigma_1}\frac{(\cos\sigma - \cosh\tau)^2}{(\cos\sigma' - \cosh\tau')^2}\right) \quad (13)$$

where $\varepsilon^i_j$ and $\mu^i_j$ are permittivity and permeability tensors in an elliptic cylindrical coordinate system.

Figure 2C:
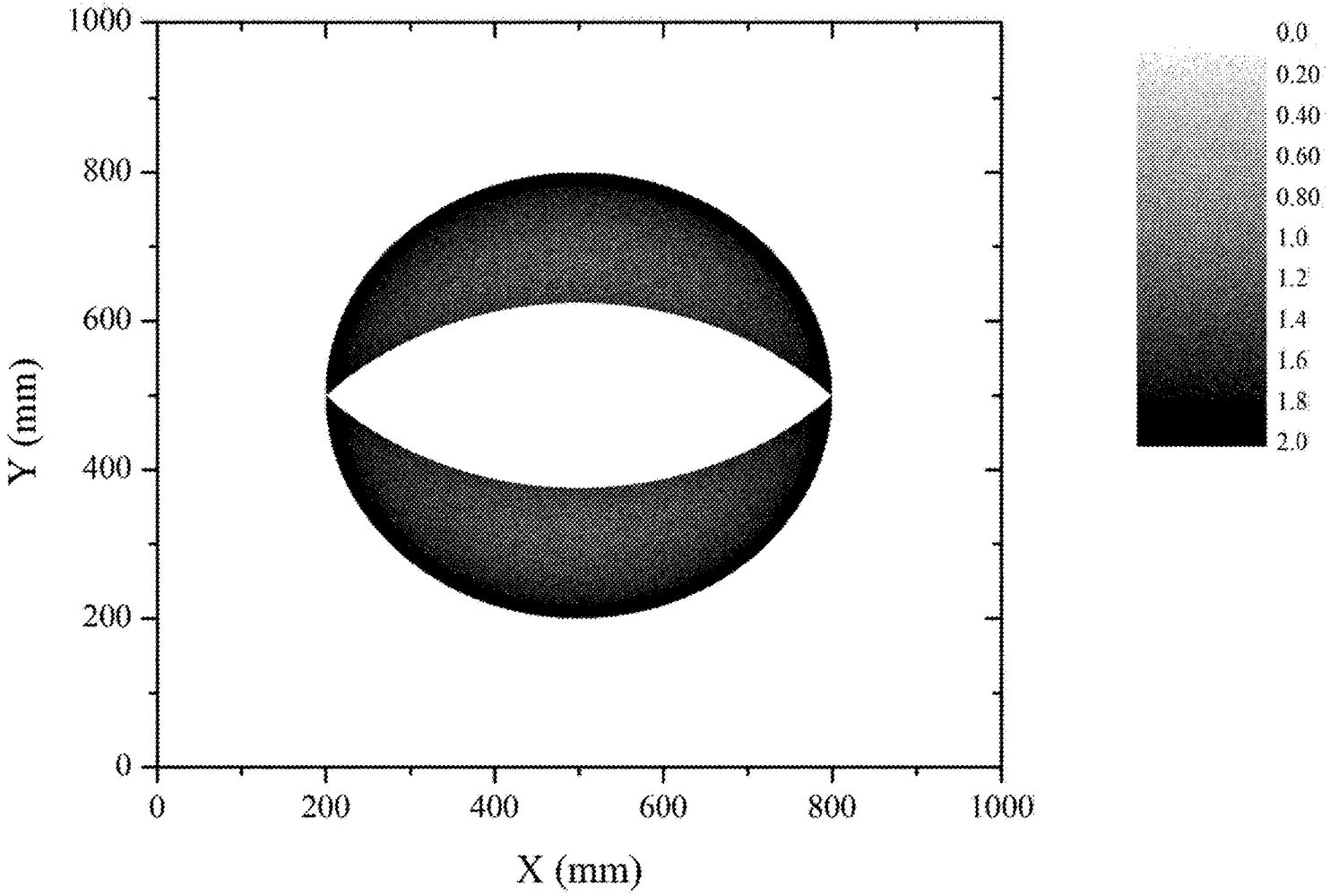

FIG. 2C shows a spatial distribution for the constitutive parameters of a bipolar cylindrical invisibility cloak, and shows a spatial distribution for $\varepsilon_z^z$ of a bipolar cylindrical cloak in which $\varepsilon_\sigma^\sigma$ and $\varepsilon_\tau^\tau$ have constant values of 0.5 and 2.0, respectively, the semi-focal distance a is 0.3 m, and $\sigma_1$ and $\sigma_2$ have 0.75 τ and 0.5 π, respectively. FIG. 2B shows a spatial distribution for $\varepsilon_z^z$ of a bipolar cylindrical cloak in which $\varepsilon_u^u$ and $\varepsilon_v^v$ have constant values of 0.75 and 1.3, respectively, the semi-focal distance "a" is 0.09 m, and $K_1$ and $K_2$ have 0.1 and 0.3, respectively.

As described above, although a conventional cloaking apparatus is designed using meta-material that surrounds an overall area where a target object is disposed, the present invention is intended to cloak the area of a target object without surrounding the overall area of the target object.

Figure 3:
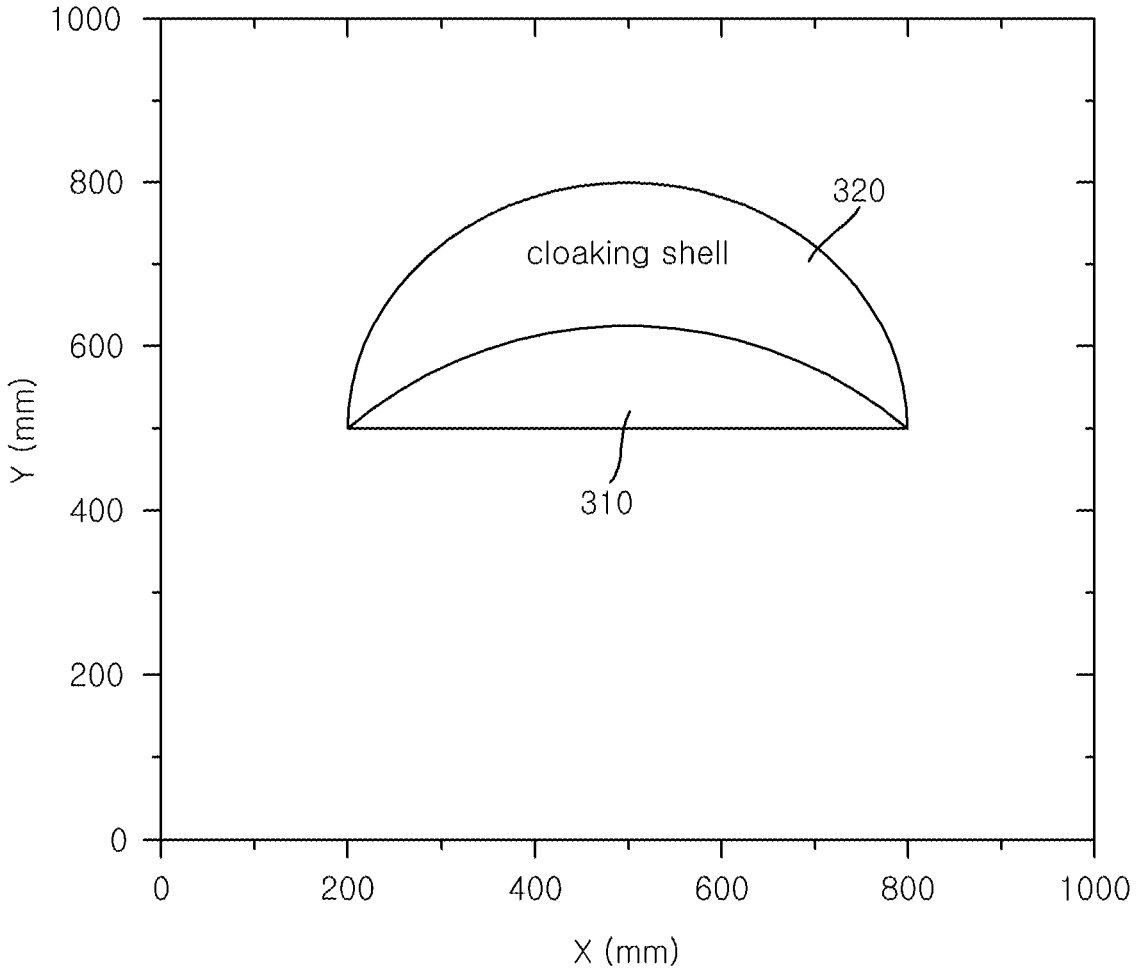
FIG. 3 shows a case where a conventional invisibility cloak has been applied to a half.
Figure 4A:
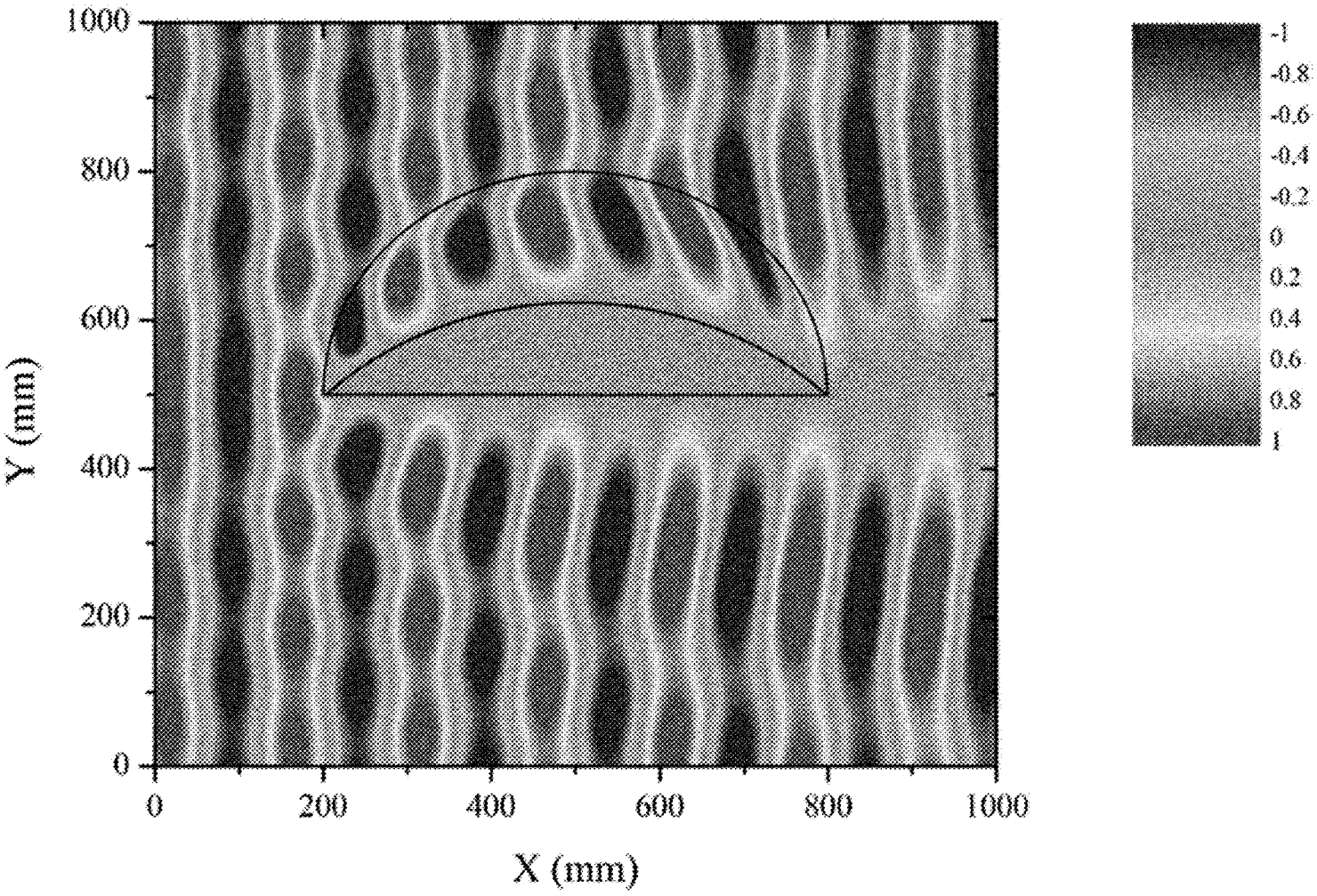
FIGS. 4A through 4D show the results of cloaking for the cloaking apparatus of FIG. 3.
Figure 4B:
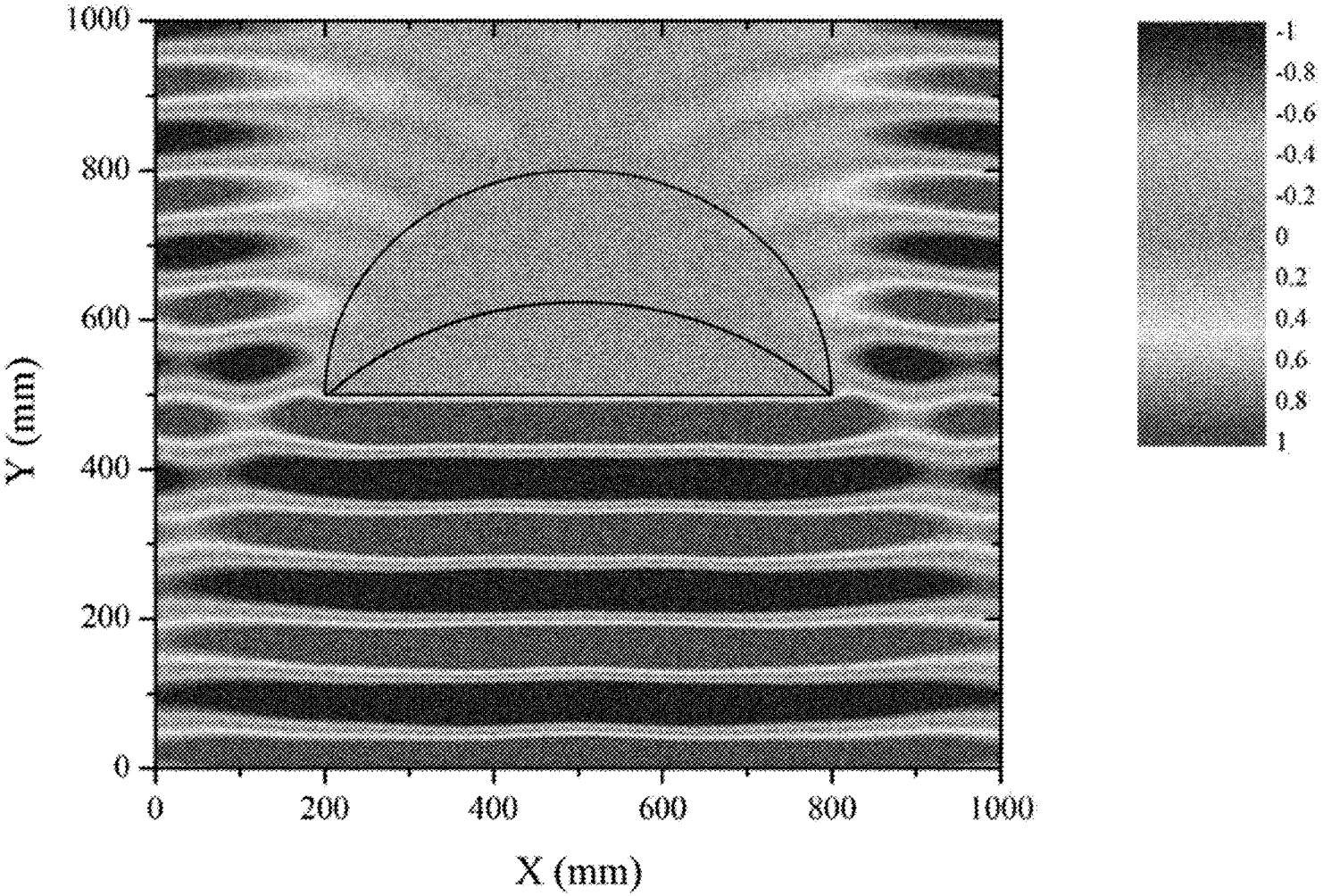
Figure 4C:
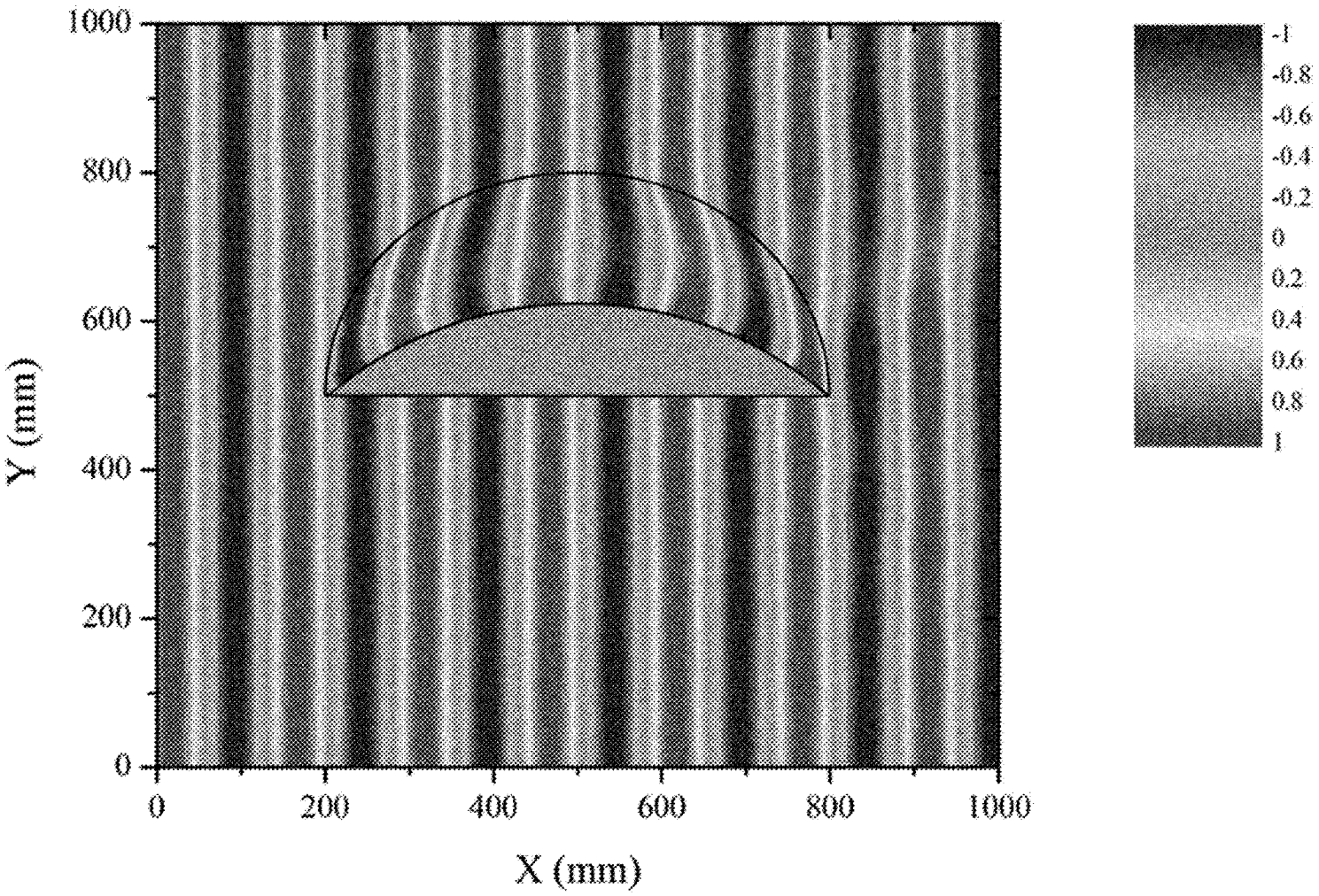
Figure 4D:
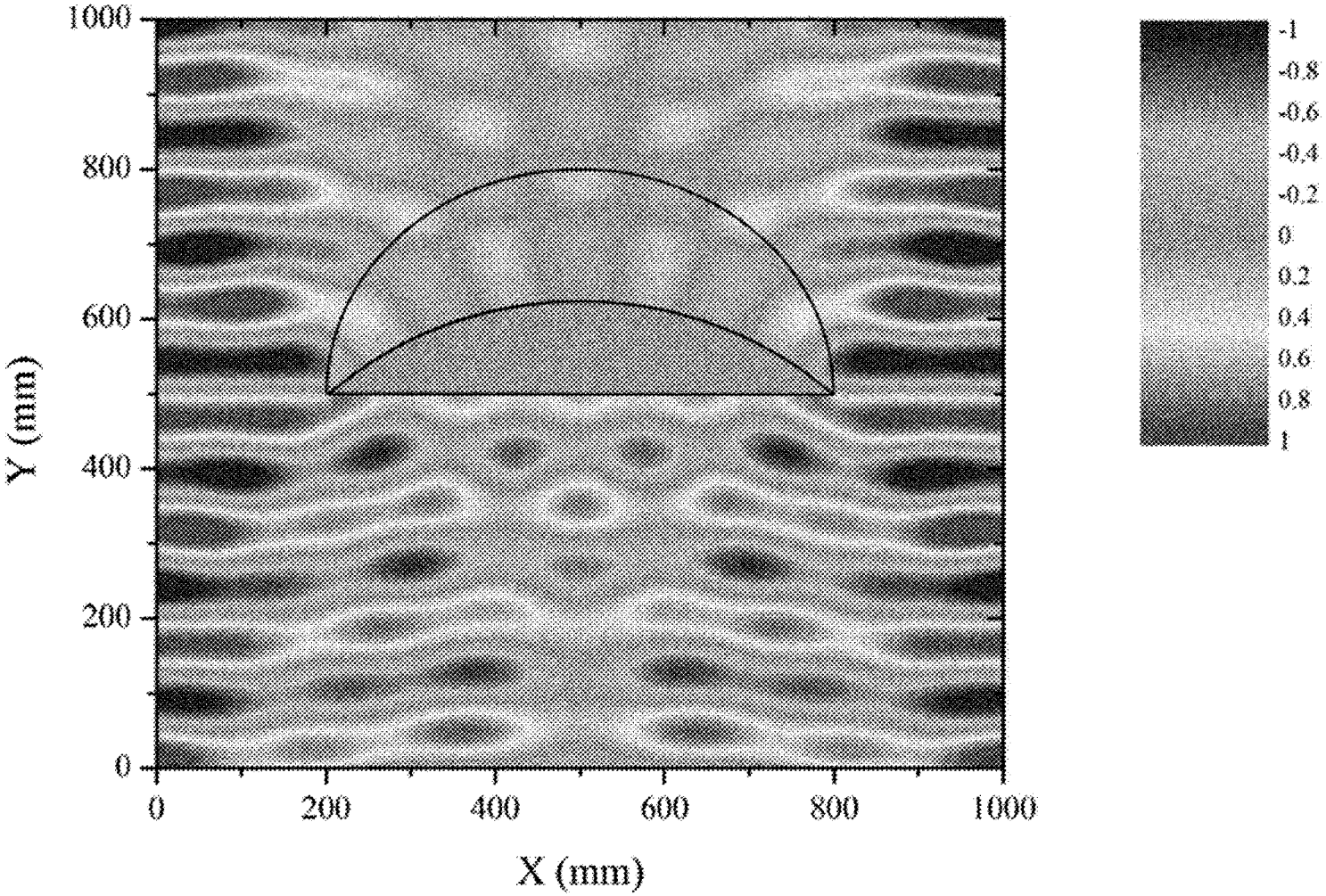

FIG. 3 shows a case where a conventional invisibility cloak has been applied to a half, and FIG. 4 shows the results of cloaking for the cloaking apparatus of FIG. 3.

Referring to FIGS. 3 and 4, a conventional cloaking shell 320 is disposed to surround part of a space 310 where a target object is disposed, as shown in FIG. 3. In this case, a 2D cloaking apparatus is illuminated using all transverse electric (TE) and transverse magnetic (TM) polarized plane waves whose operating frequency is 2 GHz (f=2 GHz) and whose wavelength is 15 cm (λ=15 cm).

In this case, an FDTD finite-difference time-domain cell size of Δx=Δy=λ/300 is used, and a temporal discretization step follows a Courant stability condition set to $\Delta t=\Delta x/2c_0$=833.91 fsec. The temporal discretization step can be easily appreciated by those skilled in the art to which the present invention pertains through a search for a paper, for example, "Electromagnetic Simulation Using the FDTD Method" published in IEEE Press, 2000, or the like.

In this case, $c_0$ is the speed of light in a vacuum.

First, a cloaking apparatus mapped to each point of the meta-material is verified, the cloaking apparatus is calculated using an FDTD method, and the cloaking apparatus is mapped to a point.

As shown in FIGS. 4A to 4D, it can be seen that in the case of the cloaking apparatus mapped to the point of the meta-material, the results of cloaking are poor as a result of FDTD numerical analysis for TE mode (FIGS. 4A and 4B), the results of cloaking are poor for the distribution of an electric field in which a TM wave propagates in a positive y direction as a result of FDTD numerical analysis for TM mode (FIGS. 4C and 4D), and the results of cloaking are desirable for the distribution of an electric field in which a TM wave propagates in a positive x direction.

That is, it can be seen that in the case where the conventional invisibility cloak has been applied to a half, cloaking performance is desirable only when a TM wave propagates in an x-axis direction.

The present invention may implement cloaking without surrounding an overall target object. The present invention is intended to design a cloaking apparatus that is capable of cloaking a target object without surrounding the overall area of the target object using complementary media for compensating for a positive refractive index.

In this case, the area of the target object may be filled with air, and the compensation area of the area of the target object for compensating for a positive refractive index may be filled with an isotropic complementary medium whose permittivity and permeability are all −1.

In this case, the isotropic compensation medium has a permittivity and permeability of −1 due to the optical cancellation of folding transformation (see Appl. Phys. A 108, 1001-1005 (2012)).

Figure 5:
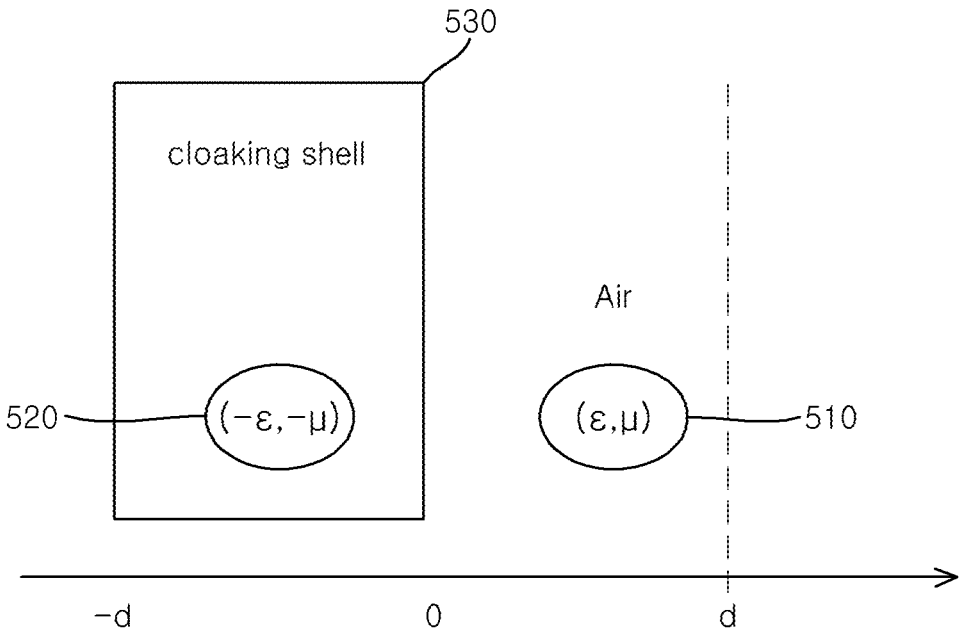
FIG. 5 shows the configuration of a cloaking apparatus according to an embodiment of the present invention.

FIG. 5 shows the configuration of a cloaking apparatus according to an embodiment of the present invention.

Referring to FIG. 5, the cloaking apparatus includes a compensation unit 520, and a cloaking shell 530.

The compensation unit 520 is disposed in a second space spaced apart from a first space 510, including a target object, by a predetermined interval, and is composed of a first meta-material having a predetermined negative refractive index.

In this case, the compensation unit 520 may be disposed in the second space in a size corresponding to the size of the first space 510 including the target object, and the negative refractive index of the first meta-material may be a negative refractive index (−ε, −μ), for example, a negative refractive index (−1, −1), for the cloaking of the target object that is obtained by compensating for the positive refractive index (ε, μ), for example, a negative refractive index (1, 1), of the first space.

The spaced interval between the compensation unit 520 and the first space 510 including the target object may be determined by taking into account the size, area and the like of the cloaking space for the target object, for example, the first space.

The cloaking shell 530 completely surrounds the compensation unit 520, is spaced apart from the first space 510 including the target object, and is composed of second meta-material for cloaking the target object.

In this case, the cloaking shell 530 may be formed in a predetermined shape, the shape of the cloaking shell 530 may be determined by taking into account the cloaking space for the target object, and a space where the cloaking shell 530 is formed may be determined by taking into account the cloaking space for the target object.

The second meta-material of the cloaking shell 530 may be designed to cloak the target object by distorting space-time surrounding the first space and the second space for electromagnetic waves, may be designed by applying an analysis technique that makes changes in the propagation paths of electromagnetic waves attributable to the distortion of space-time surrounding part of the first space and the second space correspond to refractive indices for the electromagnetic waves, or may be designed by analyzing Maxwell's equations for a coordinate system indicative of the first and the second spaces.

As described above, the cloaking apparatus according to the present embodiment is a cloaking apparatus using a compensation medium that is capable of performing cloaking without completely surrounding a given target object. The cloaking apparatus according to the present embodiment may cloak the target object in such a manner that the positive refractive index of the first space is compensated for by the negative refractive index of the compensation unit and thus the phases of electromagnetic waves passing through the target object cancel each other. That is, since electromagnetic waves in the area of $-d<x<d$ cancel each other due to the characteristics of the compensation unit, all electromagnetic waves incident onto the target object disposed outside the second space having a negative refractive index are also eliminated, and thus there are no electromagnetic waves returned to an observer, thereby achieving the cloaking of the target object.

Figure 6:
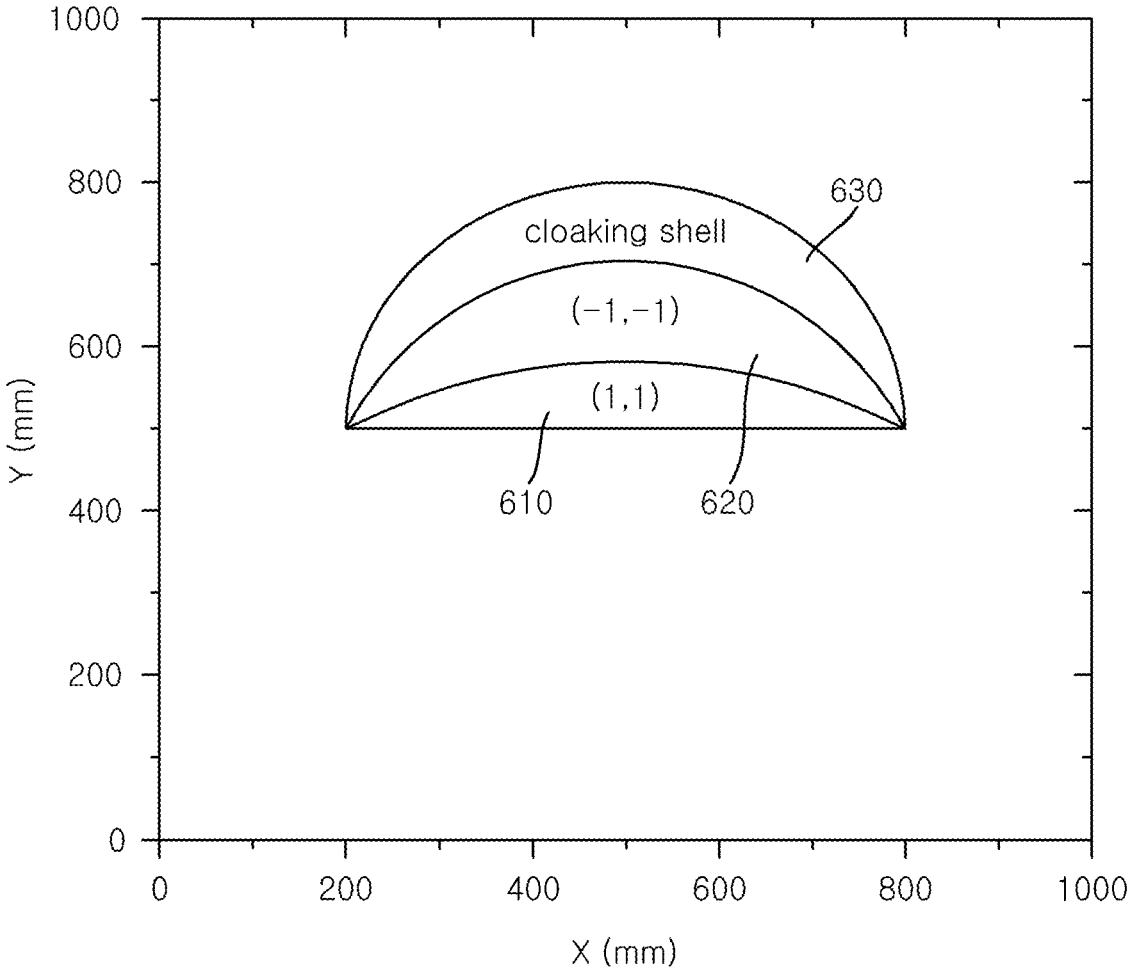
FIG. 6 shows the configuration of a cloaking apparatus according to another embodiment the present invention.

FIG. 6 shows the configuration of a cloaking apparatus according to another embodiment the present invention, which is directed to a case where a space where a target object is disposed is adjacent to the cloaking apparatus and the area of the target object has a single positive refractive index.

Referring to FIG. 6, the cloaking apparatus includes a compensation unit 620, and a cloaking shell 630.

The compensation unit 620 is disposed in a second space surrounding part of a first space 610 including the target object, and is composed of a first meta-material having a predetermined negative refractive index.

In this case, the compensation unit 620 may be disposed to surround the arc-shaped area of the semi-elliptic first space 610, and the first meta-material of the compensation unit 620 may have a negative refractive index for the cloaking of the target object by compensating for the positive refractive index of the first space 610. For example, the first meta-material may have a negative refractive index (−1, −1) whose permittivity and permeability are all −1.

The shape of the second space where the compensation unit 620 is disposed may correspond to the shape of the first space 610, and may not be limited thereto. The area where the compensation unit 620 is disposed may be determined by taking into account the cloaking of the target object.

The cloaking shell 630 surrounds part of the compensation unit 620, and is composed of a second meta-material.

In this case, the cloaking shell 630 may be disposed to completely surround the compensation unit 620 along with the first space 610 where the target area is disposed. That is, the compensation unit 620 is disposed to be located between the cloaking shell 630 and the first space 610.

The second meta-material of the cloaking shell 630 may be designed to cloak the target object by distorting space-time surrounding the first space and the second space for electromagnetic waves, may be designed by applying an analysis technique that makes changes in the propagation paths of electromagnetic waves attributable to the distortion of space-time surrounding part of the first space and the second space correspond to refractive indices for the electromagnetic waves, or may be designed by analyzing Maxwell's equations for a coordinate system indicative of the first and the second spaces.

FIGS. 7A to 7D show the results of cloaking for the cloaking apparatus of FIG. 6. That is, FIGS. 7A to 7D show the results of cloaking for the cloaking apparatus using all TE and TM polarized plane waves whose operating frequency is 2 GHz (f=2 GHz) and whose wavelength is 15 cm (λ=15 cm).

In this case, a finite-difference time-domain (FDTD) cell size of $\Delta x=\Delta y=\lambda/300$ is used, and a temporal discretization step follows a Courant stability condition set to $\Delta t=\Delta x/2c_0$ (=833.91 fsec).

Figure 7A:
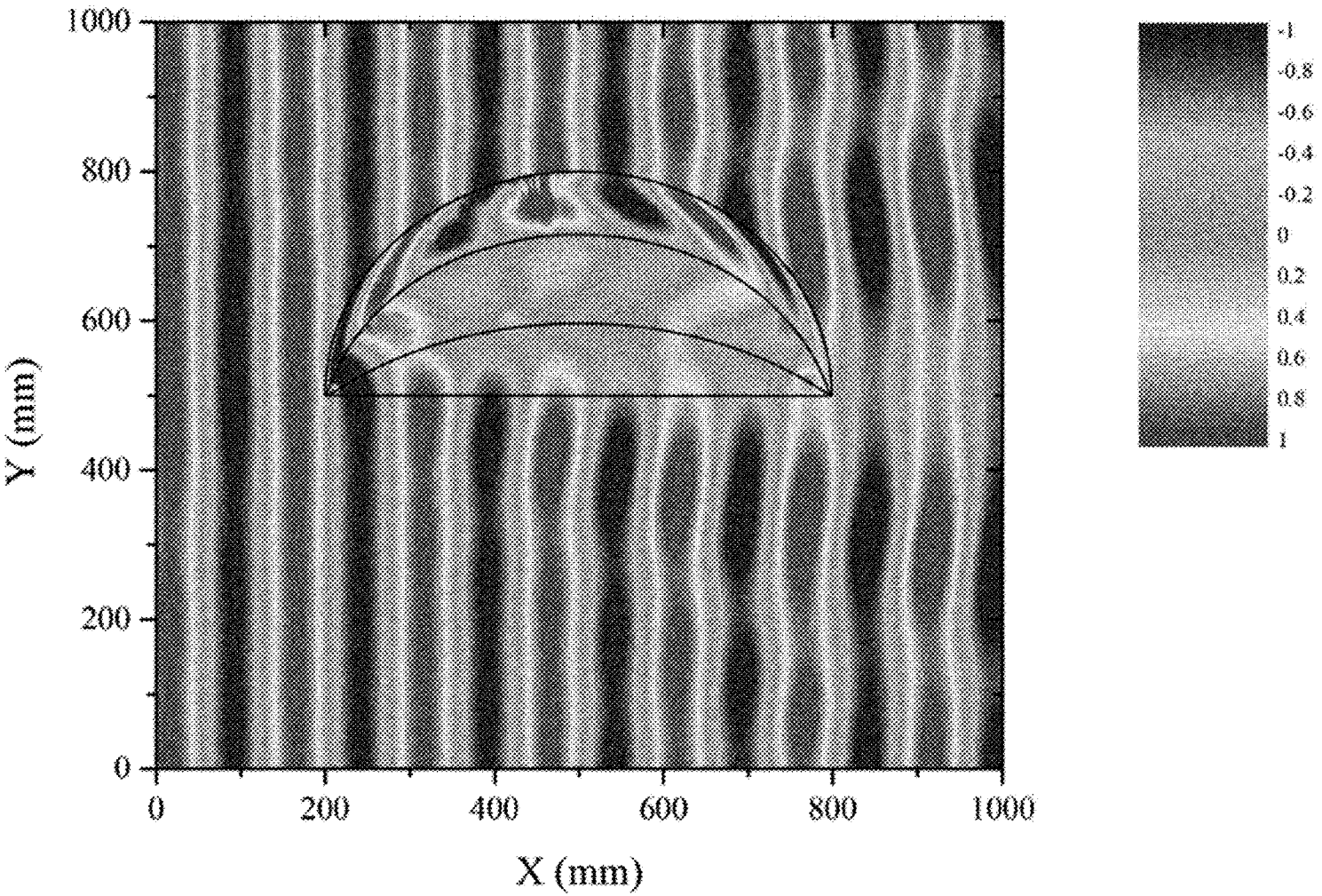
FIGS. 7A through 7D show the results of cloaking for the cloaking apparatus of FIG. 6.
Figure 7B:
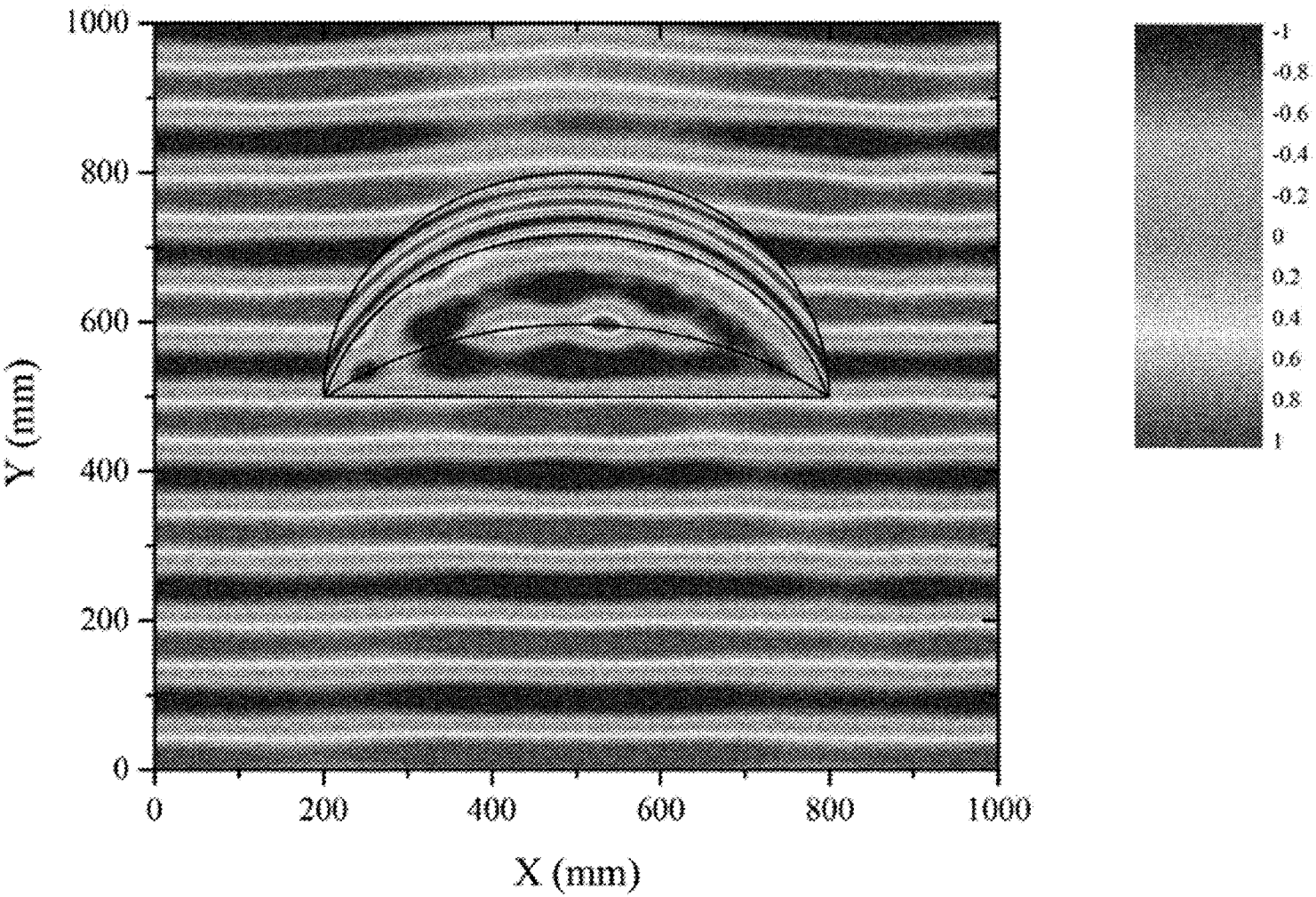
Figure 7C:
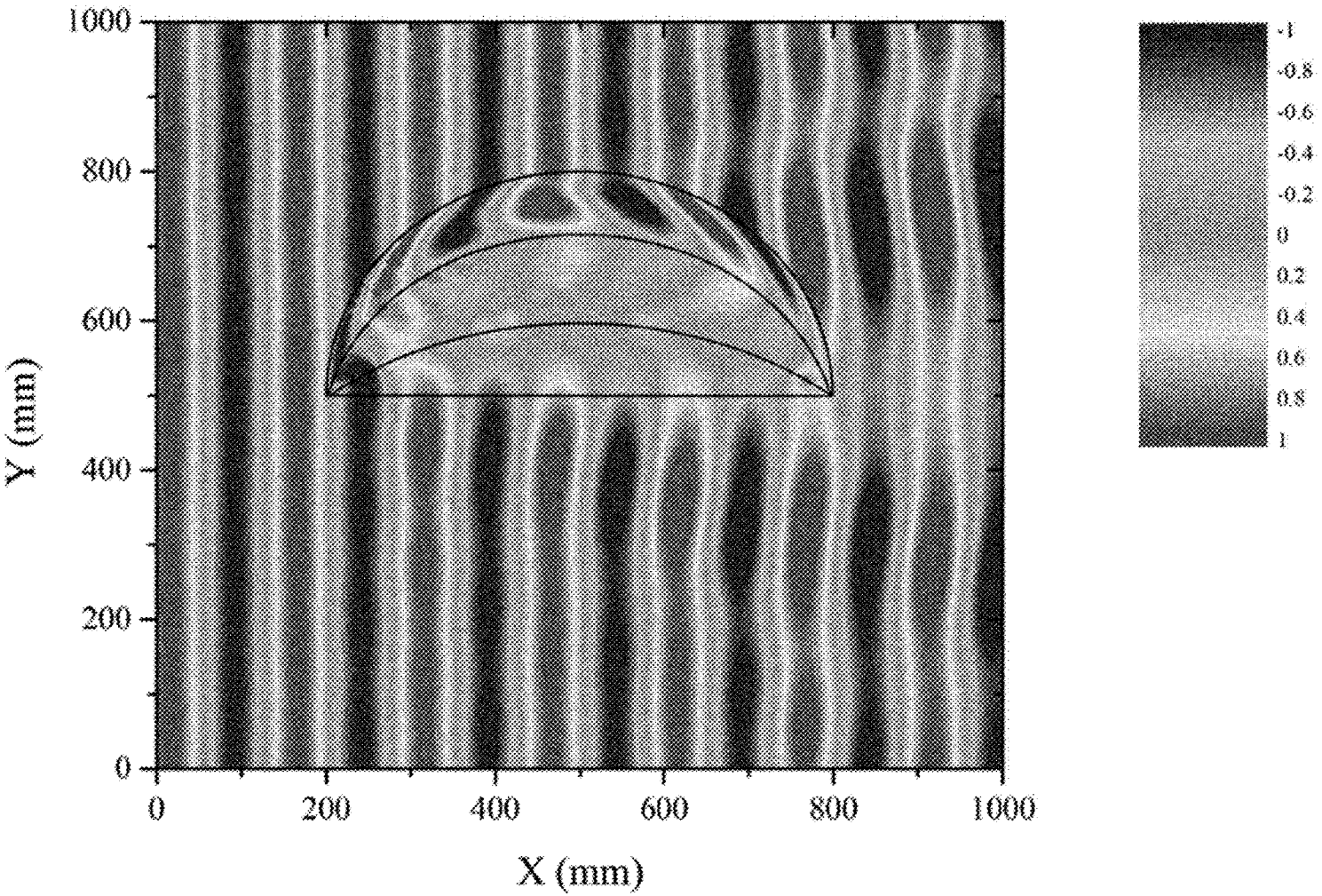
Figure 7D:
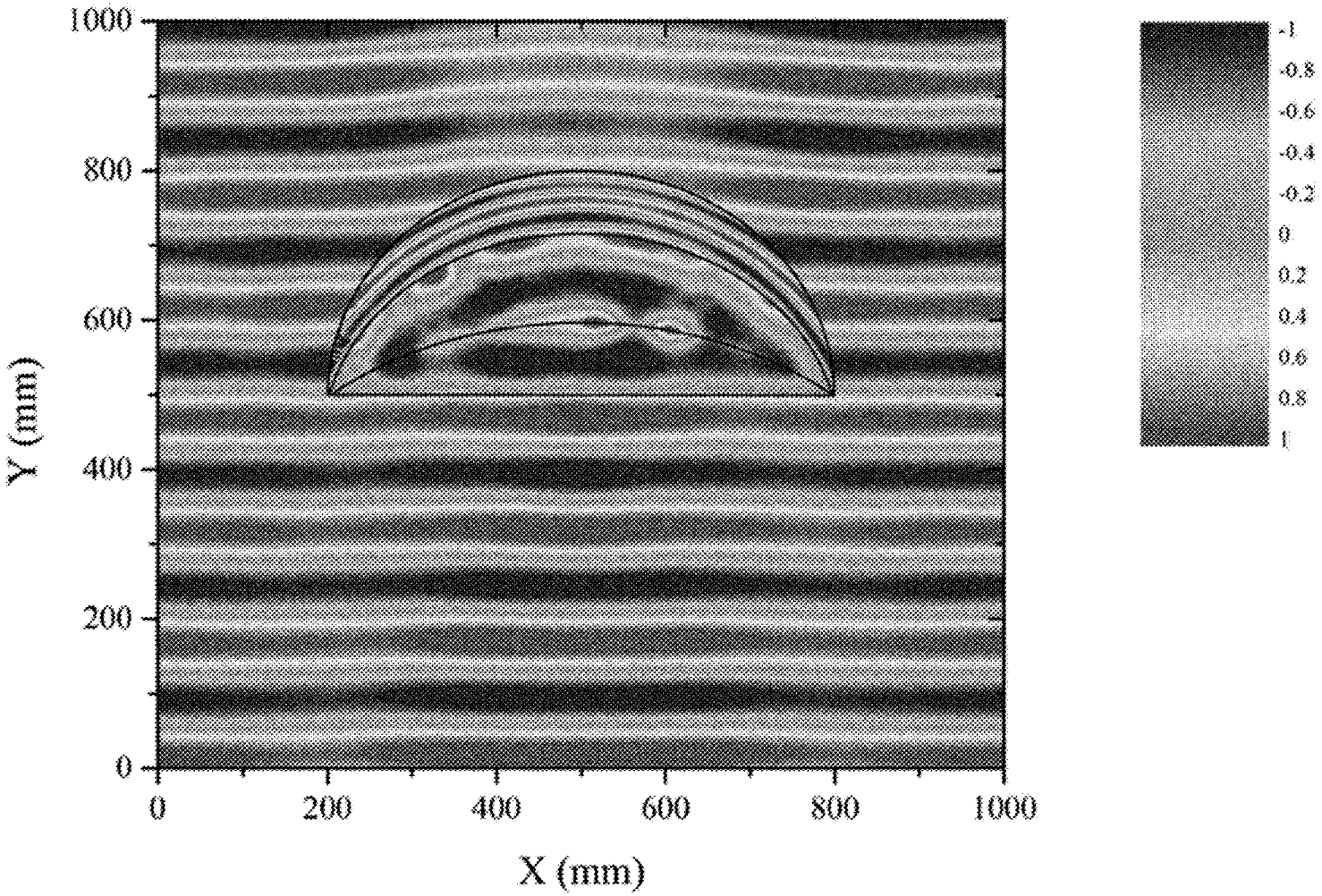

As shown in FIGS. 7A to 7D, it can be seen that the cloaking apparatus of FIG. 6 has desirable cloaking results for the distribution of an electric field in which a TE wave and a TM wave all propagate in a positive y direction and a positive x direction, as can be seen from the results of FDTD numerical analysis for TE mode (FIGS. 7A and 7B) and the results of FDTD numerical analysis for TM mode (FIGS. 7C and 7D).

That is, it can be seen that even when the cloaking apparatus using compensation medium is applied to a half of a space where a target object is disposed, desirable cloaking performance is exhibited for all x and y directions for a TE wave and a TM wave.

This cloaking apparatus according to the present embodiment may be applied to a case where a space where a target object is disposed has two or more positive refractive indices, which is described with reference to FIGS. 8 and 9.

Figure 8:
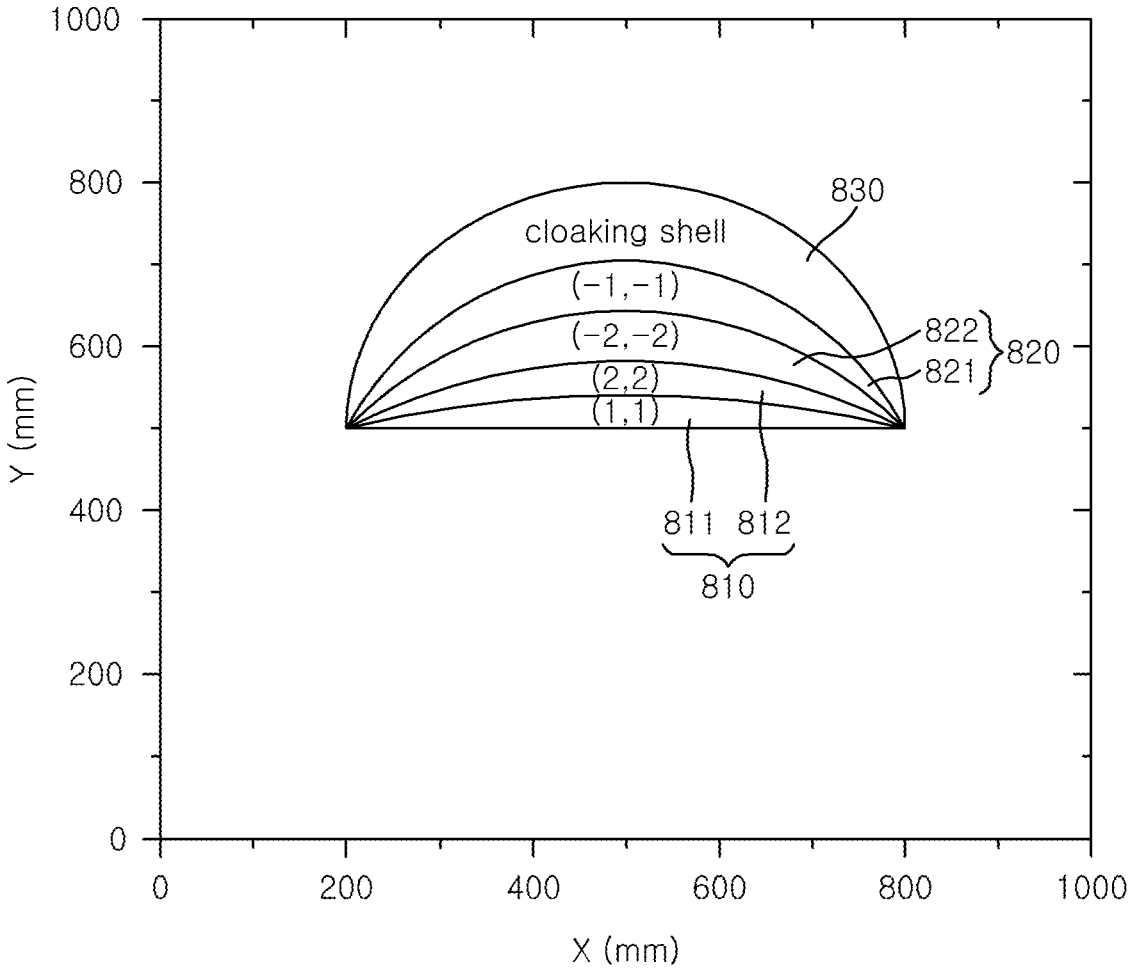
FIG. 8 shows the configuration of a cloaking apparatus according to still another embodiment of the present invention.

FIG. 8 shows the configuration of a cloaking apparatus according to still another embodiment of the present invention, and is directed to a case where a first space in which a target object is disposed has two positive refractive indices.

Referring to FIG. 8, the cloaking apparatus includes a compensation unit 820, including two sub compensation units 821 and 822, and a cloaking shell 830.

The two sub compensation units 821 and 822 that constitute the compensation unit 820 are disposed to be symmetrical to spaces 811 and 812 for positive refractive indices in order to compensate for the two positive refractive indices that constitute the first space 810. That is, when the area 811 corresponding to the first positive refractive index and the area 812 corresponding to the second positive refractive index are sequentially formed, the sub compensation unit 822 for compensating for the second positive refractive index and the sub compensation unit 821 for compensating for the first positive refractive index may be sequentially disposed in reverse order.

The sub compensation units are described as follows.

The first sub compensation unit 821 is a sub compensation unit for compensating for the first positive refractive index, for example, a positive refractive index (1, 1), of the first space 810, and is composed of meta-material, having a negative refractive index, for example, a negative refractive index (−1, −1), for compensating for the first positive refractive index.

In this case, the first sub compensation unit 821 may be disposed between the second sub compensation unit 822 and the cloaking shell 830.

The second sub compensation unit 822 is a sub compensation unit for compensating for the second positive refractive index, for example, a positive refractive index (2, 2), of the first space 810, and is composed of meta-material, having a negative refractive index, for example, a negative refractive index (−2, −2), for compensating for the second positive refractive index.

In this case, the second sub compensation unit 822 may be disposed between the first sub compensation unit 821 and the first space 810.

The cloaking shell 830 surrounds part of the compensation unit 820, and is composed of a second meta-material.

In this case, the cloaking shell 830 may be disposed to completely surround the compensation unit 820 along with the first space 810 where the target area is disposed. That is, the compensation unit 820 is disposed to be located between the cloaking shell 830 and the first space 810.

The second meta-material of the cloaking shell 830 may be designed to cloak the target object by distorting space-time surrounding the first space and the second space for electromagnetic waves, may be designed by applying an analysis technique that makes changes in the propagation paths of electromagnetic waves attributable to the distortion of space-time surrounding part of the first space and the second space correspond to refractive indices for the electromagnetic waves, or may be designed by analyzing Maxwell's equations for a coordinate system indicative of the first and the second spaces.

FIGS. 9A to 9D show the results of cloaking for the cloaking apparatus of FIG. 8. That is, FIGS. 9A to 9D show the results of cloaking for the cloaking apparatus using all TE and TM polarized plane waves whose operating frequency is 2 GHz (f=2 GHz) and whose wavelength is 15 cm ($\lambda$=15 cm).

In this case, a finite-difference time-domain (FDTD) cell size of $\Delta x=\Delta y=\lambda/300$ is used, and a temporal discretization step follows a Courant stability condition set to $\Delta t=\Delta x/2c_0$ (=833.91 fsec).

Figure 9A:
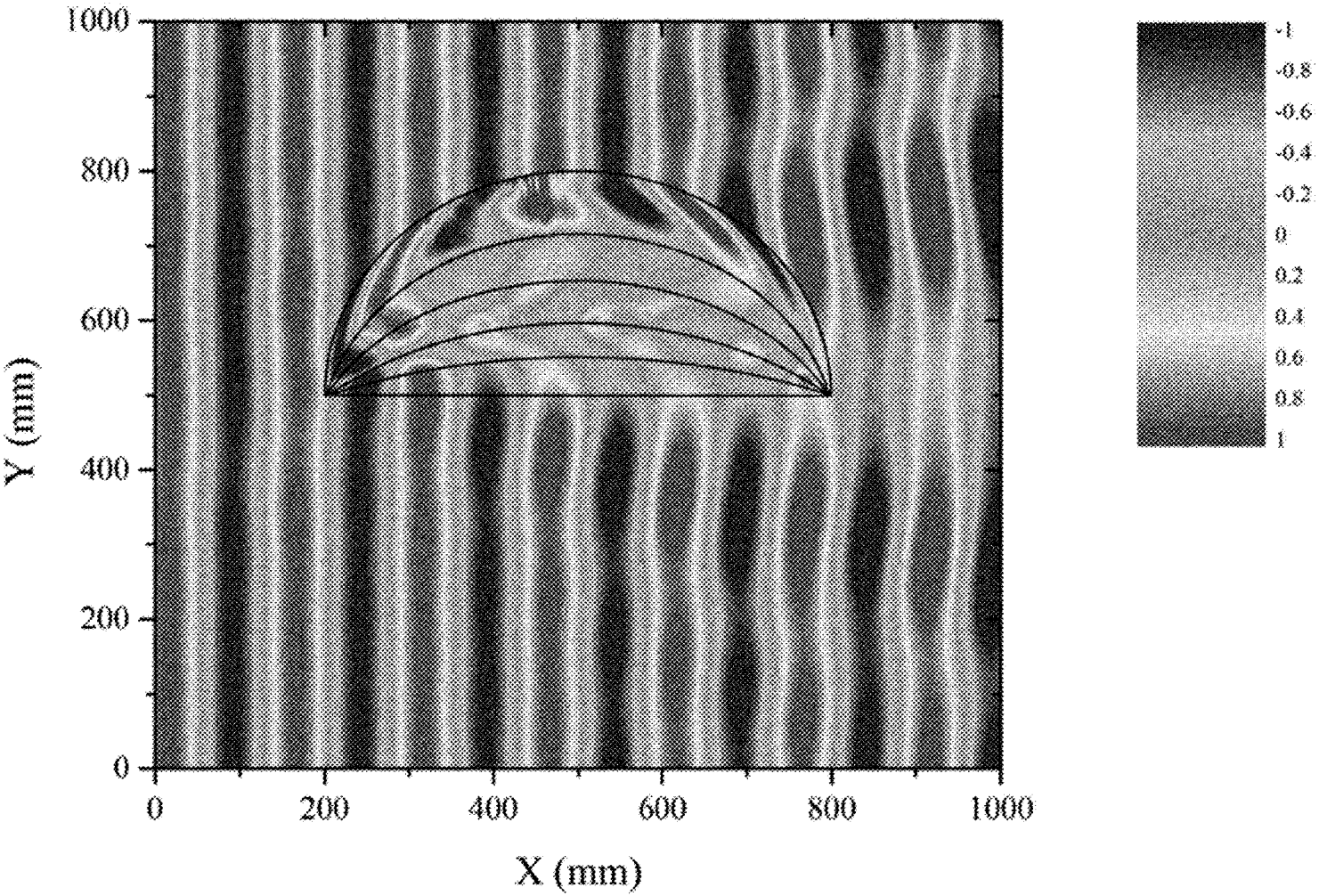
FIGS. 9A through 9D show the results of cloaking for the cloaking apparatus of FIG. 8.
Figure 9B:
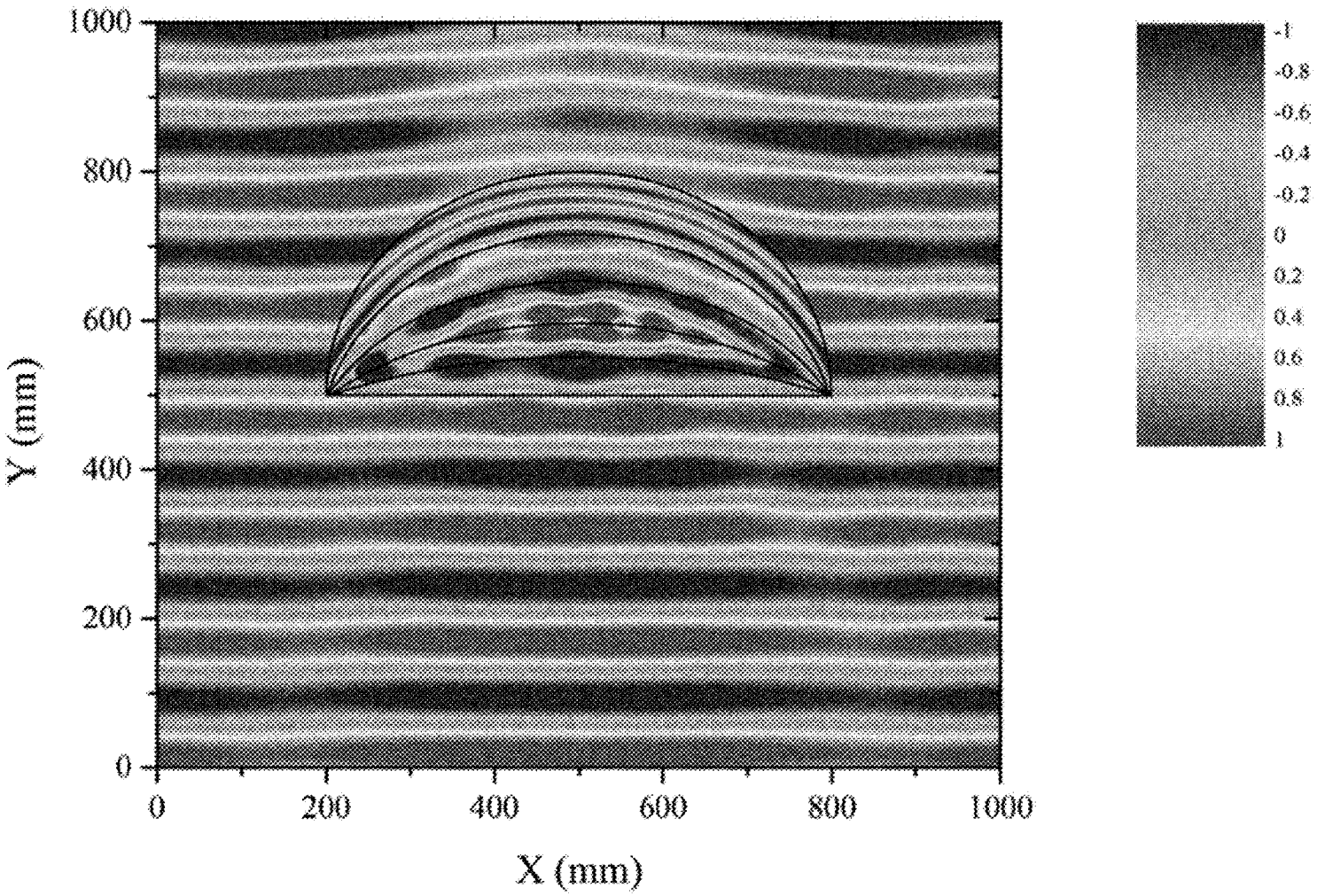
Figure 9C:
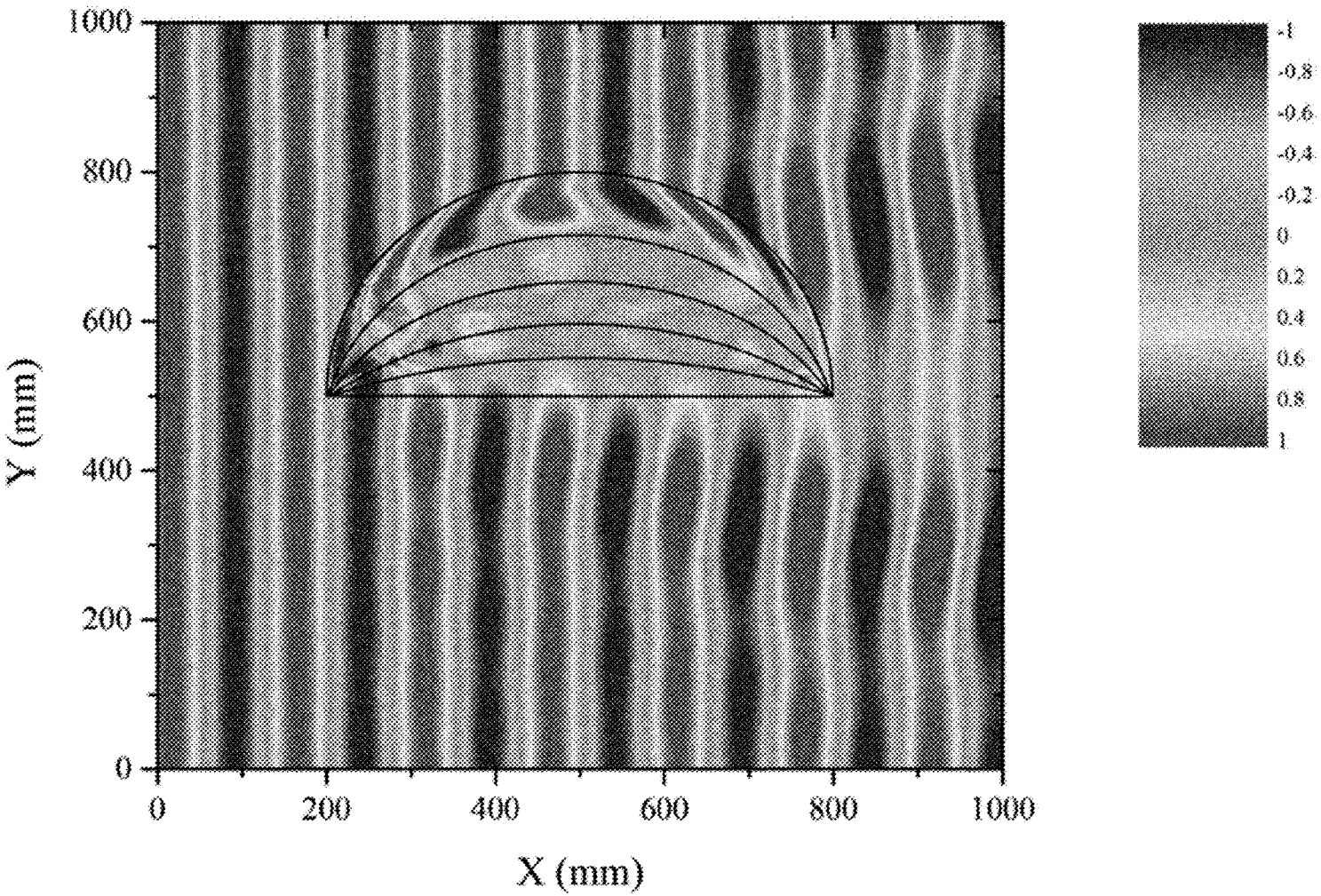
Figure 9D:
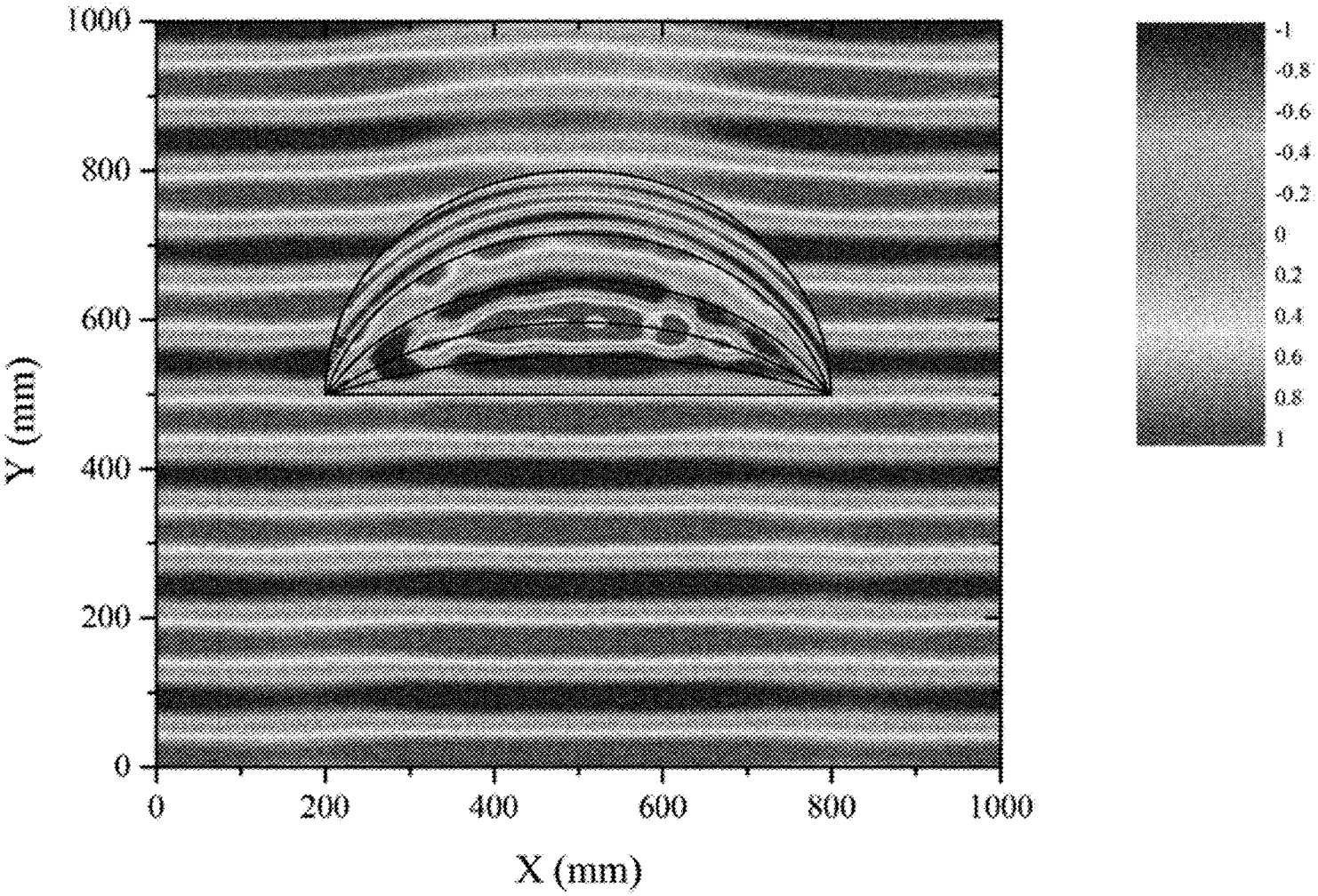

As shown in FIGS. 9A to 9D, it can be seen that the cloaking apparatus of FIG. 8 has desirable cloaking results for the distribution of an electric field in which a TE wave and a TM wave all propagate in a positive y direction and a positive x direction, as can be seen from the results of FDTD numerical analysis for TE mode (FIGS. 9A and 9B) and the results of FDTD numerical analysis for TM mode (FIGS. 9C and 9D).

That is, it can be seen that even when the cloaking apparatus using compensation medium is applied to a half of a space where a target object is disposed, desirable cloaking performance is exhibited for all x and y directions for a TE wave and a TM wave.

As described above, the cloaking apparatus according to the present embodiment is disposed such that a compensation medium having a negative refractive index for compensating for the positive refractive index of the first space including a target object to be hidden is disposed to surround part of the first space and a compensation medium is disposed between the first space and the invisibility cloak, thereby improving cloaking without surrounding an overall target object and also improving cloaking performance for various types of polarized light, such as an incident wave as well as a TE wave and a TM wave.

Furthermore, the present invention may be applied using a cloaking method.

Figure 10:
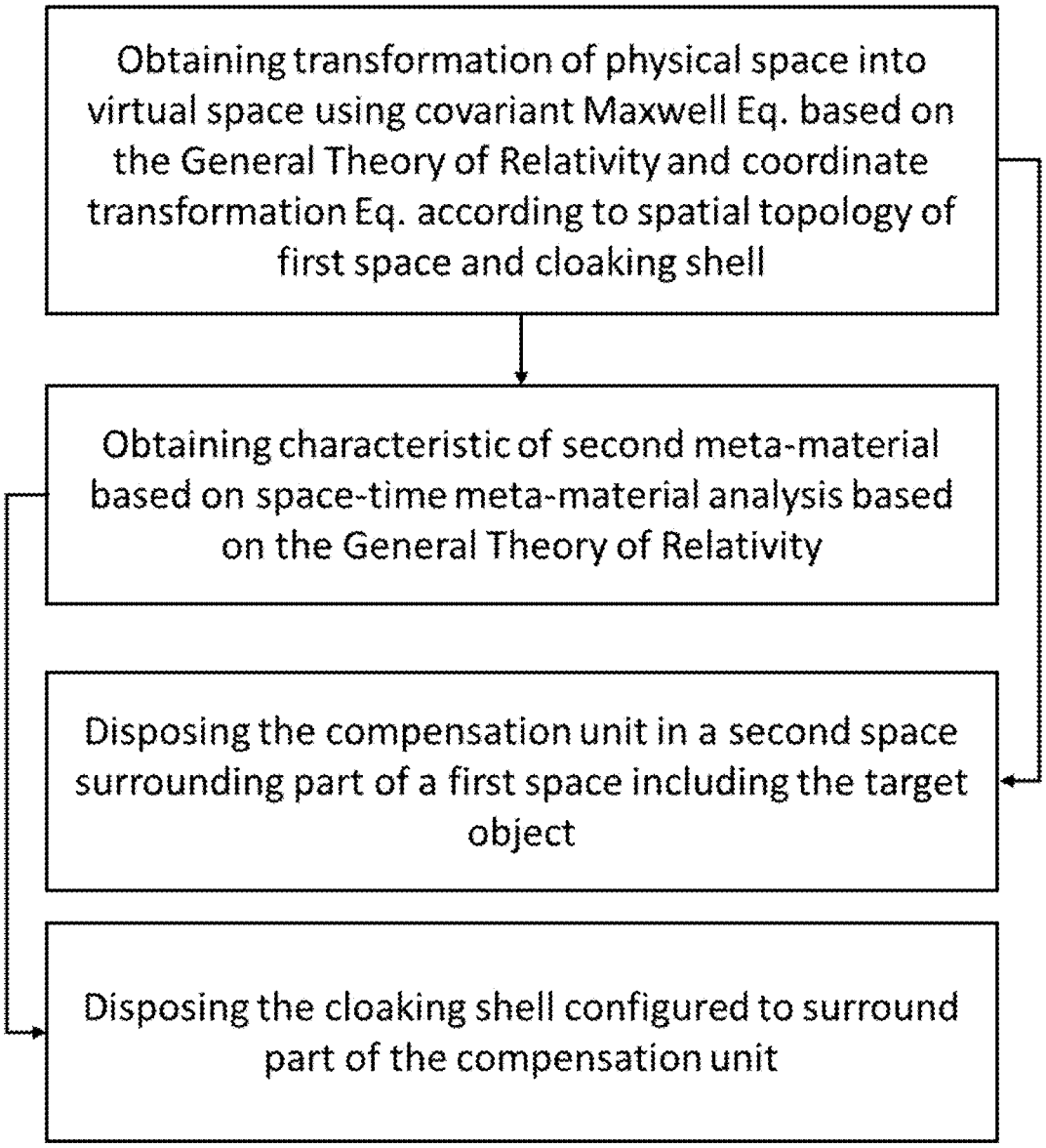
FIG. 10 shows a flow chart illustrating an example of a method of providing a cloaking apparatus according to an embodiment of the present invention.

FIG. 10 shows a flow chart illustrating an example of a method of providing a cloaking apparatus according to an embodiment of the present invention.

As an example, referring to FIG. 10, in the cloaking method according to the present embodiment corresponding to FIG. 5, a compensation unit composed of a first meta-material having a predetermined negative refractive index is disposed in a second space spaced apart from a first space, including a target object, by a predetermined interval, and a cloaking shell surrounding the compensation unit and composed of a second meta-material is disposed to be spaced apart from the first space.

In this case, the cloaking shell may correspond to a cloaking shell shown in FIG. 5, and the compensation unit may correspond to a space having a negative refractive index (−1, −1). That is, the negative refractive index of the first meta-material may be a negative refractive index that is adapted to cloak the target object by compensating for the positive refractive index of the first space.

In this case, the location at which the compensation unit is disposed and the area in which the cloaking shell is disposed may be determined by taking into account a cloaking space for the target object.

Furthermore, the second meta-material constituting the cloaking shell may be designed to cloak the target object by distorting space-time surrounding the first space and the second space for electromagnetic waves, may be designed by applying an analysis technique that makes changes in the propagation paths of electromagnetic waves attributable to the distortion of space-time surrounding part of the first space and the second space correspond to refractive indices for the electromagnetic waves, or may be designed by analyzing Maxwell's equations for a coordinate system indicative of the first and the second spaces.

As another example, in the cloaking method according to the present embodiment corresponding to FIGS. 6 and 8, a compensation unit composed of a first meta-material having a predetermined negative refractive index is disposed in a second space surrounding part of a first space including a target object and a cloaking shell composed of a second meta-material is disposed to surround part of the compensation unit.

In this case, the cloaking shell may correspond to the cloaking shell shown in FIGS. 6 and 8, and the compensation unit may correspond to a space having a negative refractive index (−1, −1) shown in FIG. 6 or a space having negative refractive indices (−1, −1) and (−2, −2) including the two sub compensation units shown in FIG. 8.

The negative refractive index of the compensation unit may be a negative refractive index that is adapted to cloak the target object by compensating for the positive refractive index of the first space including the target object.

The compensation unit may include at least two sub compensation units, composed of meta-material having a negative refractive index, for compensating for at least two positive refractive indices in the case where the first space has at least two positive refractive indices, and the two or more sub compensation units may be disposed in a second space to be symmetrical to spaces for at least two positive refractive indices by taking into account the negative refractive indices of the respective sub compensation units.

Furthermore, the second meta-material constituting the cloaking shell may be designed to cloak the target object by distorting space-time surrounding the first space and the second space for electromagnetic waves, may be designed by applying an analysis technique that makes changes in the propagation paths of electromagnetic waves attributable to the distortion of space-time surrounding part of the first space and the second space correspond to refractive indices for the electromagnetic waves, or may be designed by analyzing Maxwell's equations for a coordinate system indicative of the first and the second spaces.

The cloaking apparatus and method according to the present invention are capable of improving the cloaking of a target object by compensating for the positive refractive index of the area of the target object in such a manner that meta-material having a negative refractive index is disposed to surround part of a space where the target object is disposed.

Furthermore, the cloaking apparatus and method according to the present invention are capable of performing cloaking for polarized light having an arbitrary direction, not a specific direction, using a compensation meta-material having a negative refractive index for compensating for the positive refractive index of a space where a target object is disposed.

While the present invention has been described in conjunction with specific details, such as specific elements, and limited embodiments and diagrams above, these are provided merely to help an overall understanding of the present invention. The present invention is not limited to these embodiments, and various modifications and variations can be made based on the foregoing description by those having ordinary knowledge in the art to which the present invention pertains.

Therefore, the technical spirit of the present invention should not be determined based only on the described embodiments, and the following claims, all equivalents to the claims and equivalent modifications should be construed as falling within the scope of the spirit of the present invention.

What is claimed is:

1. A method of providing a cloaking apparatus including a compensation unit and a cloaking shell for cloaking a target object using meta-material, comprising:

disposing the compensation unit, composed of a first meta-material having a predetermined negative refractive index, in a second space surrounding part of a first space including the target object; and disposing the cloaking shell configured to surround part of the compensation unit and composed of a second meta-material, wherein a characteristic of the second meta-material is calculated based on a space-time meta-material analysis based on the General Theory of the Relativity, wherein an empty space of a physical space corresponding to the first space to be hidden with the target object is transformed into a virtual space that has a point the empty space of the physical space is transformed thereto, so that the empty space of the physical space is hidden from external electromagnetic waves, and wherein the transformation of the physical space into the virtual space is obtained using covariant Maxwell's equations based on the General Theory of Relativity, and using a coordinate transformation equation according to a spatial topology of the first space and the cloaking shell.

2. The method of claim 1, wherein the negative refractive index is adapted to cloak the target object by compensating for a positive refractive index of the first space.

3. The method of claim 1, wherein the disposing the compensation unit comprises disposing at least two sub compensation units, composed of meta-material having a negative refractive index, for compensating for each of the at least two positive refractive indices when the first space has at least two positive refractive indices.

4. The method of claim 3, wherein the at least two sub compensation units are disposed to be symmetrical to spaces for the at least two positive refractive indices by taking into account negative refractive indices of the sub compensation units.

5. The method of claim 1, wherein the second meta-material is designed to cloak the target object by distorting space-time surrounding the first space and the second space for electromagnetic waves.

6. The method of claim 5, wherein the second meta-material is designed by applying an analysis technique that makes changes in propagation paths of the electromagnetic waves attributable to distortion of space-time surrounding part of the first space and the second space correspond to refractive indices for the electromagnetic waves.

7. A method of providing a cloaking apparatus including a compensation unit and a cloaking shell for cloaking a target object using meta-material, comprising:

disposing the compensation unit, composed of a first meta-material having a predetermined negative refractive index, in a second space spaced apart from a first space including the target object, by a predetermined interval; and disposing the cloaking shell configured to surround the compensation unit and composed of a second meta-material, to be spaced apart from the first space, wherein a characteristic of the second meta-material is calculated based on a space-time meta-material analysis based on the General Theory of the Relativity, wherein an empty space of a physical space corresponding to the first space to be hidden with the target object is transformed into a virtual space that has a point the empty space of the physical space is transformed thereto, so that the empty space of the physical space is hidden from external electromagnetic waves, and wherein the transformation of the physical space into the virtual space is obtained using covariant Maxwell's equations based on the General Theory of Relativity, and using a coordinate transformation equation according to a spatial topology of the first space and the cloaking shell.

8. The method of claim 7, wherein the predetermined interval and a space in which the cloaking shell is disposed are determined by taking into account a cloaking space for the target object.

9. The method of claim 7, wherein the compensation unit is disposed in the second space having a size corresponding to a size of the first space.

10. The method of claim 7, wherein the negative refractive index is adapted to cloak the target object by compensating for a positive refractive index of the first space.

* * * * *